US007353796B2

(12) United States Patent
Sharudenko et al.

(10) Patent No.: US 7,353,796 B2
(45) Date of Patent: Apr. 8, 2008

(54) ROTARY MACHINE

(76) Inventors: Andrey Y. Sharudenko, ul. 26-i Bakinskikh komissarov, 10-6-38, 117576 Moscow (RU); Olga M. Sharudenko, ul. Chertanovskaya, 39-1-37, 113519, Moscow (RU)

( * ) Notice: Subject to any disclaimer, the term of this patent is extended or adjusted under 35 U.S.C. 154(b) by 92 days.

(21) Appl. No.: 10/548,406

(22) PCT Filed: Oct. 31, 2003

(86) PCT No.: PCT/RU03/00463

§ 371 (c)(1),
(2), (4) Date: Sep. 8, 2005

(87) PCT Pub. No.: WO2005/024203

PCT Pub. Date: Mar. 17, 2005

(65) Prior Publication Data

US 2006/0204392 A1 Sep. 14, 2006

(30) Foreign Application Priority Data

Sep. 10, 2003 (RU) ..... 2003127441

(51) Int. Cl.
*F02B 53/00* (2006.01)

(52) U.S. Cl. ..... 123/241; 418/259; 418/224; 418/255; 418/82; 418/101

(58) Field of Classification Search ..... 123/241; 418/259, 268, 224, 255, 82, 101
See application file for complete search history.

(56) References Cited

U.S. PATENT DOCUMENTS 802,920 A * 10/1905 Egersdurfer ..... 418/137
830,124 A * 9/1906 Weeks ..... 418/35
1,155,794 A * 10/1915 Clark ..... 123/240
1,636,799 A * 7/1927 Berntsen ..... 123/241
1,703,294 A * 2/1929 Campbell ..... 418/103
1,848,754 A * 3/1932 Lanzerotti-Spina ..... 418/137

(Continued)

FOREIGN PATENT DOCUMENTS

CH 622059 A5 * 3/1981

(Continued)

*Primary Examiner*—Thomas Denion
*Assistant Examiner*—Mary A Davis
(74) *Attorney, Agent, or Firm*—McDermott Will & Emery LLP

(57) ABSTRACT

The rotary machine can be used as a rotary internal combustion engine and as a pneumatic or hydraulic pump. The rotary machine comprises a housing in the form of two intersecting cylinder parts of different diameters having parallel axes. A rotor is received in the housing coaxially with the smaller-diameter cylinder and comprises at least two segmental rotor parts provided with annular rotor covers. At least two pairs of annular elements are provided engaging with the segmental rotor parts. Pivotal elements are interposed between the annular elements of each pair. A driving member is accommodated movably in the openings of the pivotal elements. The axis of rotation of the driving member is coincident with the axis of the larger-diameter inner cylindrical surface of the housing. The driving member defines inner variable-volume working chambers between the segmental parts of the rotor and the driving member, and the outer variable-volume working chambers between the driving member, the inner housing surfaces and the outer rotor surfaces.

16 Claims, 27 Drawing Sheets

U.S. PATENT DOCUMENTS

| | | | | |
|---|---|---|---|---|
| 2,966,898 | A * | 1/1961 | Jacobs et al. | 123/247 |
| 3,886,909 | A * | 6/1975 | Balsbaugh | 418/173 |
| 4,023,540 | A * | 5/1977 | Zollenkopf | 123/240 |
| 5,352,295 | A | 10/1994 | Chou | |
| 5,399,076 | A * | 3/1995 | Matsuda et al. | 418/6 |
| 5,421,706 | A * | 6/1995 | Martin, Sr. | 417/371 |
| 6,481,988 | B2 * | 11/2002 | Valentinovich | 418/61.1 |

FOREIGN PATENT DOCUMENTS

| | | | |
|---|---|---|---|
| CN | 1715617 | A * | 1/2006 |
| FR | 2 798 159 | A1 | 3/2001 |
| FR | 2 798 160 | A1 | 3/2001 |
| RU | 2097585 | C1 | 11/1997 |
| RU | 2113606 | C1 | 6/1998 |
| RU | 2183754 | C2 | 6/2002 |
| SU | 1772375 | A1 | 10/1992 |

* cited by examiner 4-4

5-5

6-6

"3-3 left"

"3-3 right"

ROTARY MACHINE

This application is the U.S. National Phase under 35 U.S.C. § 371 of International Application No. PCT/RU2003/000463, filed Oct. 31, 2003, which in turn claims the benefit of Russian Application No. RU 2003127441, filed Sep. 10, 2003, the disclosures of which Applications are incorporated by reference herein in their entirety.

FIELD OF INVENTION

This inventions relates to power engineering, and in particular, to engine building, and more specifically, to rotary internal combustion engines, and pneumatic and hydraulic pumping units.

BACKGROUND ART

Known in the art are rotary machines comprising a housing and a rotor received within the housing (cf. U.S. Pat. No. 5,472,327, published on Dec. 5, 1995; U.S. Pat. No. 5,102,314, published on Apr. 7, 1992; U.S. Pat. No. 5,558,509, published on Sep. 24, 1996; Russian Patent RU No. 2,084,659, published on Jul. 20, 1997; and Russian Patent RU No. 2,013,593, published on May 30, 1994).

A disadvantage of existing machines is their inadequate wear resistance and, therefore, reliability.

Also known in the art is a rotary machine, which was chosen by the Applicant as the closest prior art and which comprises a housing and a rotor received in the housing (cf. Russian Patent RU No. 2,187,656, published on Aug. 20, 2002).

A disadvantage of the immediate prior art rotary machine is its complex design, high material consumption, low technological efficiency, and high unit costs.

SUMMARY OF THE INVENTION

The claimed invention is aimed at developing a rotary machine of general-purpose kinematical design, in which the rotor produces an effective torque every 180 degrees of revolution and simultaneously with the revolution of the rotor the working fluid is compressed, a working (power) stroke is performed, the waste working fluid chambers are purged, and a new portion of working fluid is drawn in to enable the rotary machine to operate as an internal combustion engine or a pump.

The technical effect of the invention consists in simplifying the machine design, lowering the material consumption rate, improving machining efficiency, and cutting unit costs, all other conditions remaining unchanged, by using less complicated and less expensive manufacturing techniques.

This technical effect is achieved in a rotary machine comprising a housing and a rotor received therein, characterized in that the inner surface of the housing is shaped by two intersecting cylinder parts having different diameters and parallel axes: the rotor received in the housing is coaxial with the smaller-diameter cylinder and has at least two segmental rotor parts mounting annular rotor covers and at least two pairs of annular elements connected in pairs and adapted to turn relative to the segmental rotor parts; the machine further comprises pivotal elements accommodated between the annular elements of each pair; a driving member, whose axis of rotation is coincident with the axis of the larger-diameter cylinder and which is received in the openings of the pivotal elements for movement therein to bring working surfaces of said driving member, during rotation thereof, into contact with inner working surfaces of the segmental rotor parts, rotor covers, and an inner end-face and said cylindrical surfaces of the housing in order to define inner variable-volume working chambers between the segmental rotor parts and the driving member, and outer variable-volume working chambers between the driving member, the inner surfaces of the housing, and the outer surfaces of the rotor.

The above technical effect is also achieved as a result of the following developments:

In one of the embodiments of this invention, the pairs of annular elements can move in inner annular guides of the segmental rotor parts and engage the later alternately.

In another embodiment of this invention, the pairs of annular elements embrace the segmental rotor parts and enter into contact with the inner cylindrical surface of a smaller-diameter housing and are capable of moving in the annular guides of segmental rotor parts and being engaged by the segmental rotor parts.

In a further embodiment of this invention, the pairs of annular elements can embrace the segmental rotor parts and enter into contact with the inner cylindrical surface of the smaller-diameter housing and be capable of moving in the annular guides of one another and engaging the segmental rotor parts. Besides, the pairs of annular elements also can move in the annular guides of the rotor covers in all the three embodiments, As the pairs of annular elements move relative to one another, they can envelope one another on two sides.

The pivotal elements can have openings complementary with the shape of the driving member to allow the same to slide therein.

The end-faces of the pivotal elements can be positioned at points where the annular elements are connected to the rolling-contact bearings.

The openings of the pivotal elements can be adapted to receive rolling-contact bearings to be engaged by the driving member.

The annular elements can be provided with reinforcing and cooling plates.

The driving member can be designed in the form of a single plate or several interconnected plates and can have a two-, three- or multi-lobed shape in cross-section so that the lobes are received in the pivotal elements, the angles between the lobes are identical, and the working surface of each segmental rotor part has a two-sided shape so that the angle between the lobes is equal to the angle between the sides to permit contact between the driving member and the segmental rotor parts upon rotation thereof.

The driving member can have parallel sides and rounded portions on the surface interacting with the inner larger-diameter cylindrical surface of the housing.

The rounded portions of the driving member surfaces can have a radius of curvature larger than the distance from the center of rotation of the rotor to the pivotal elements.

The driving member of the rotary machine comprises a housing, wherein each part thereof is provided, between its axis of rotation thereof and one of the working surfaces designed to engage the inner cylindrical surface of the housing, with inner chambers, one of which is a first combustion working chamber and the second chamber is designed to be filled with working fluid to subsequently purge the first working chamber that is designed for a fuel mixture to be injected thereinto and for combustion products to be discharged into a main working chamber of the rotary machine.

LIST OF DRAWINGS

EXAMPLES OF PREFERRED EMBODIMENTS OF THE INVENTION

Figure 1:
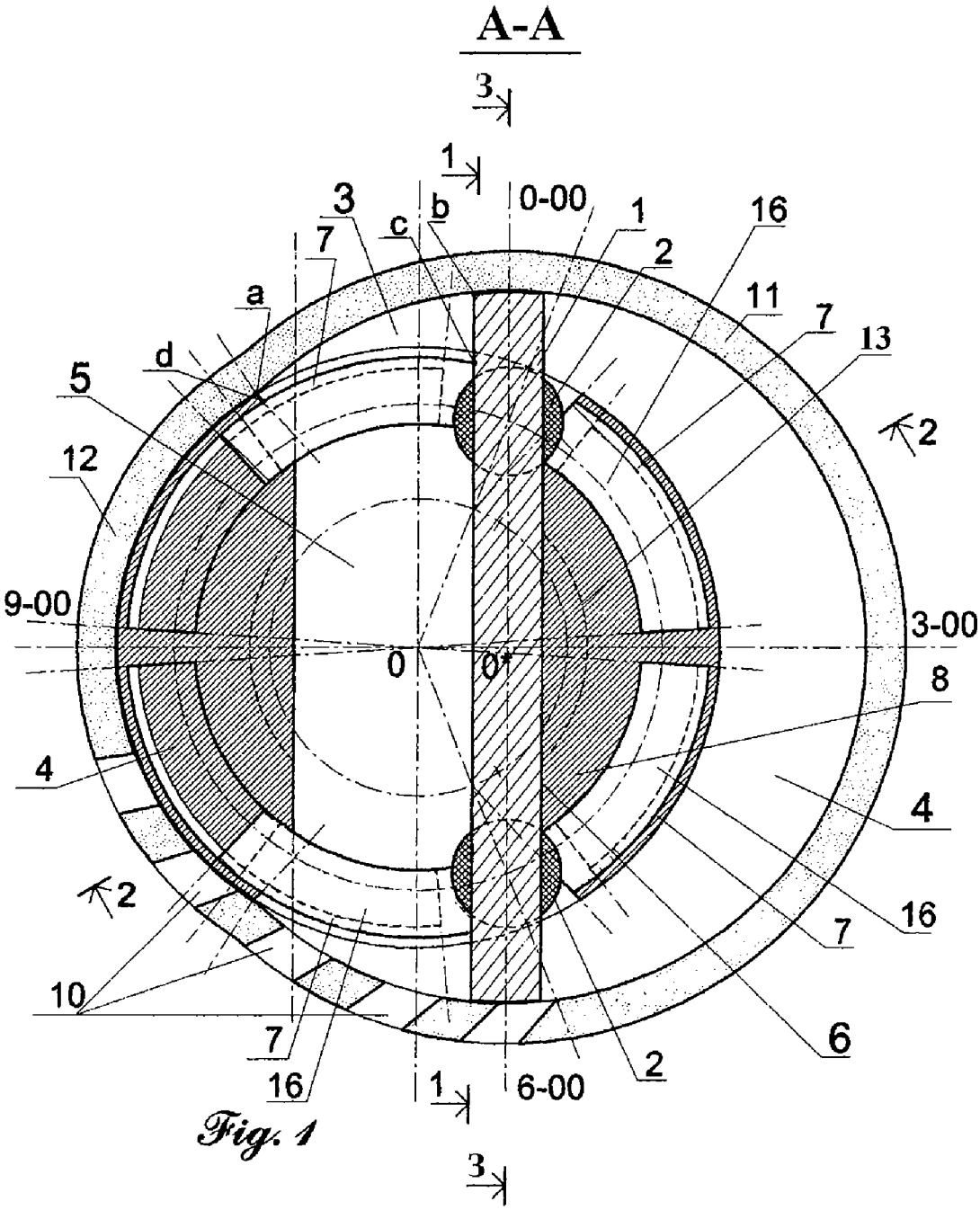
FIGS. 1 to 7 illustrate a first rotary machine, wherein rotor elements are designed as at least two segments having annular guides interconnected by annular elements provided for movement in the annular guides of the segments.
Figure 2:
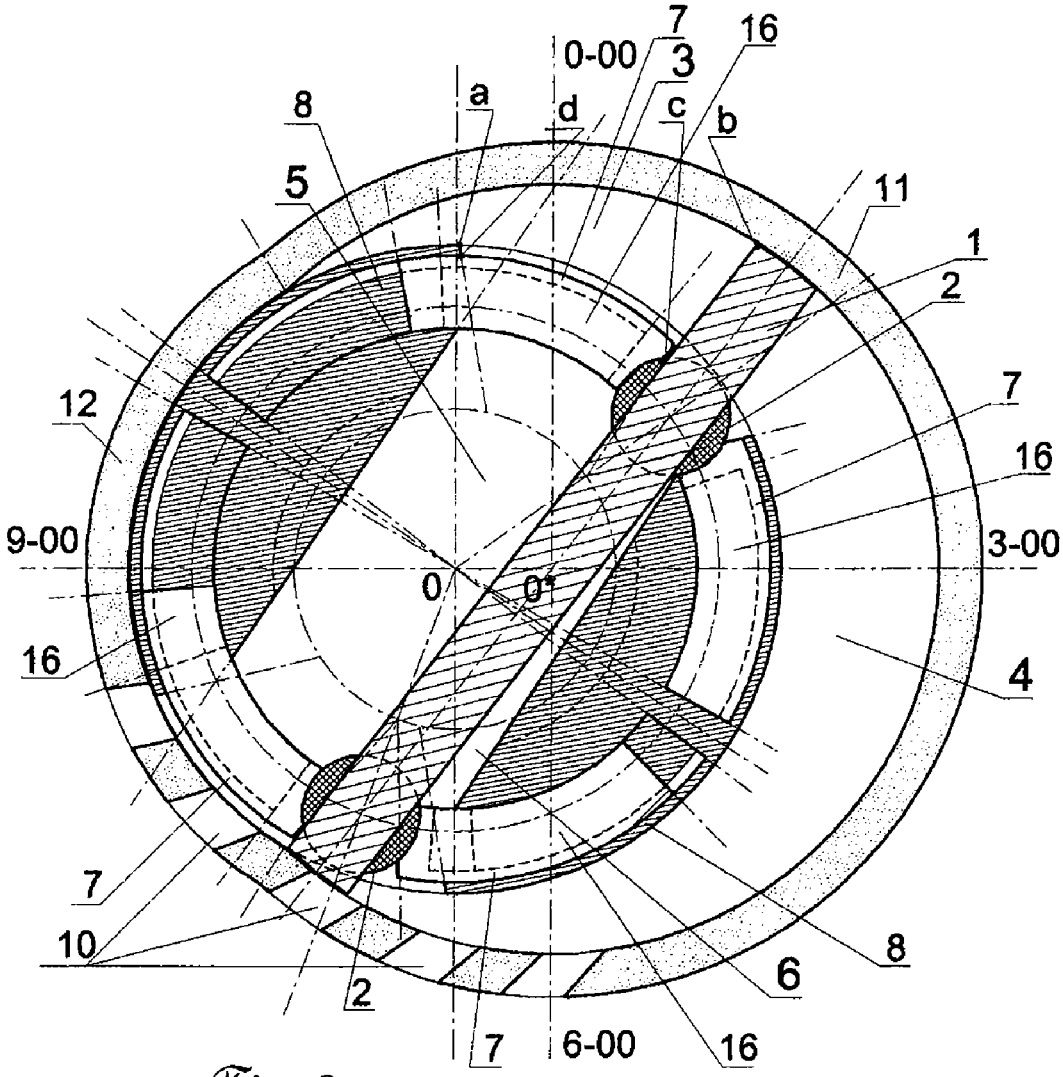
Figure 3:
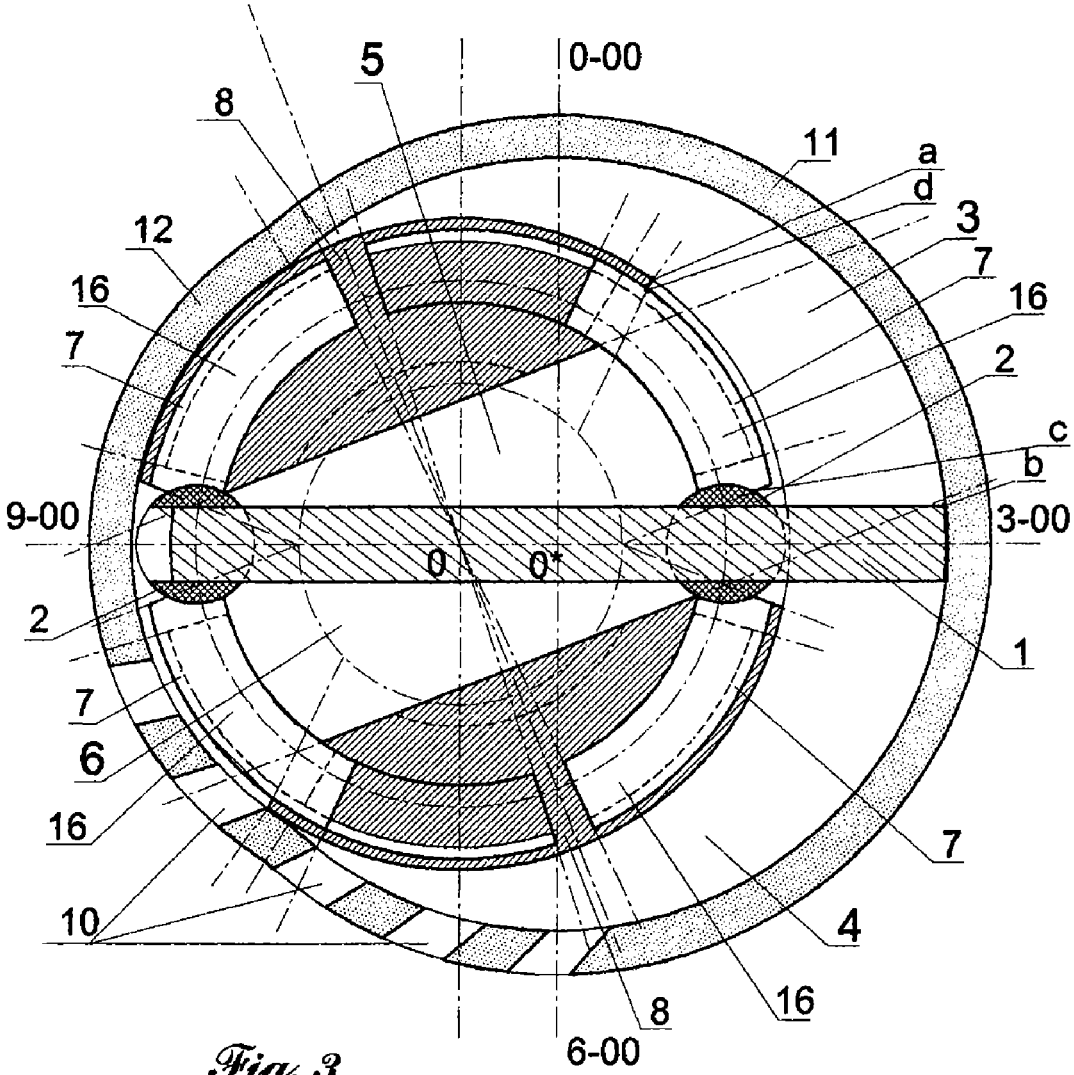
Figure 4:
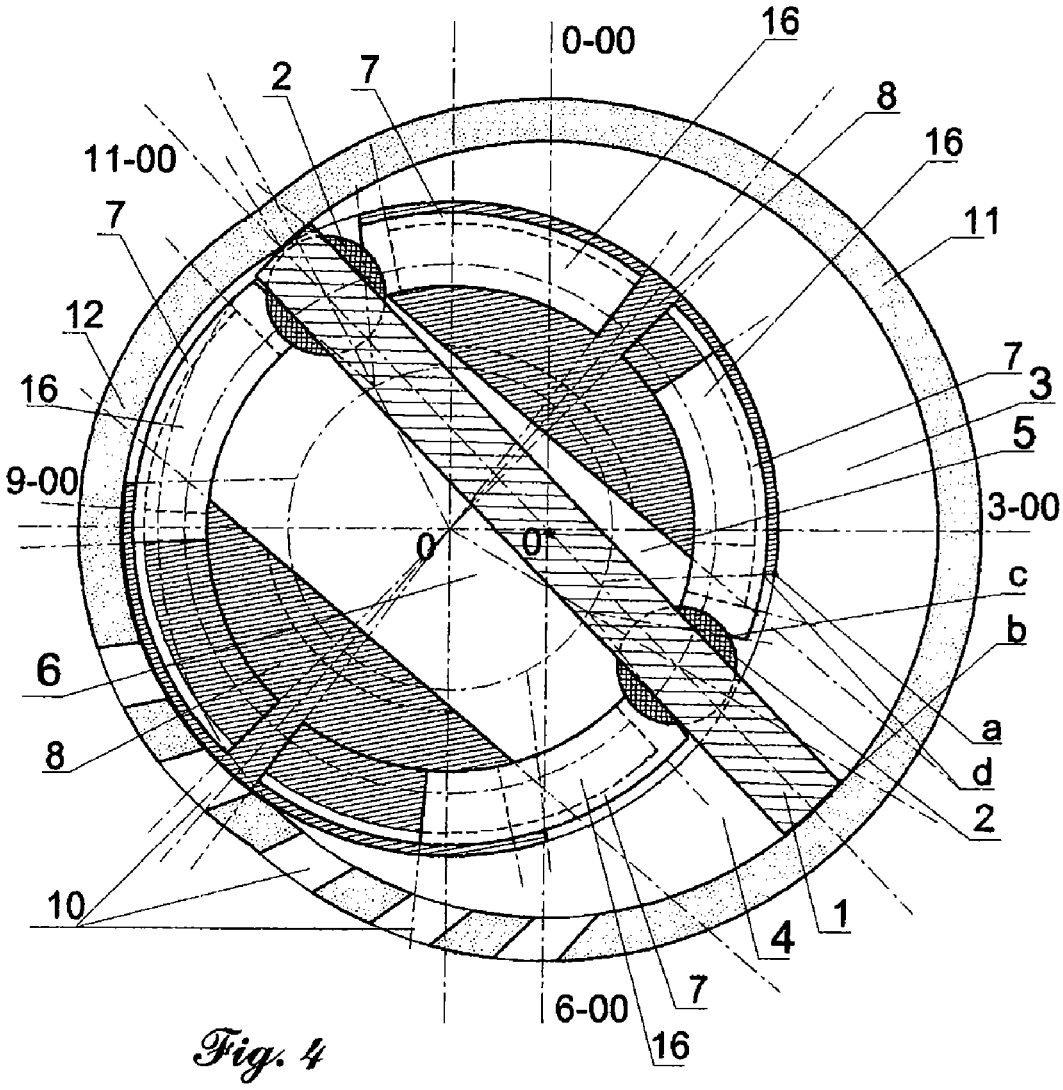
Figure 5:
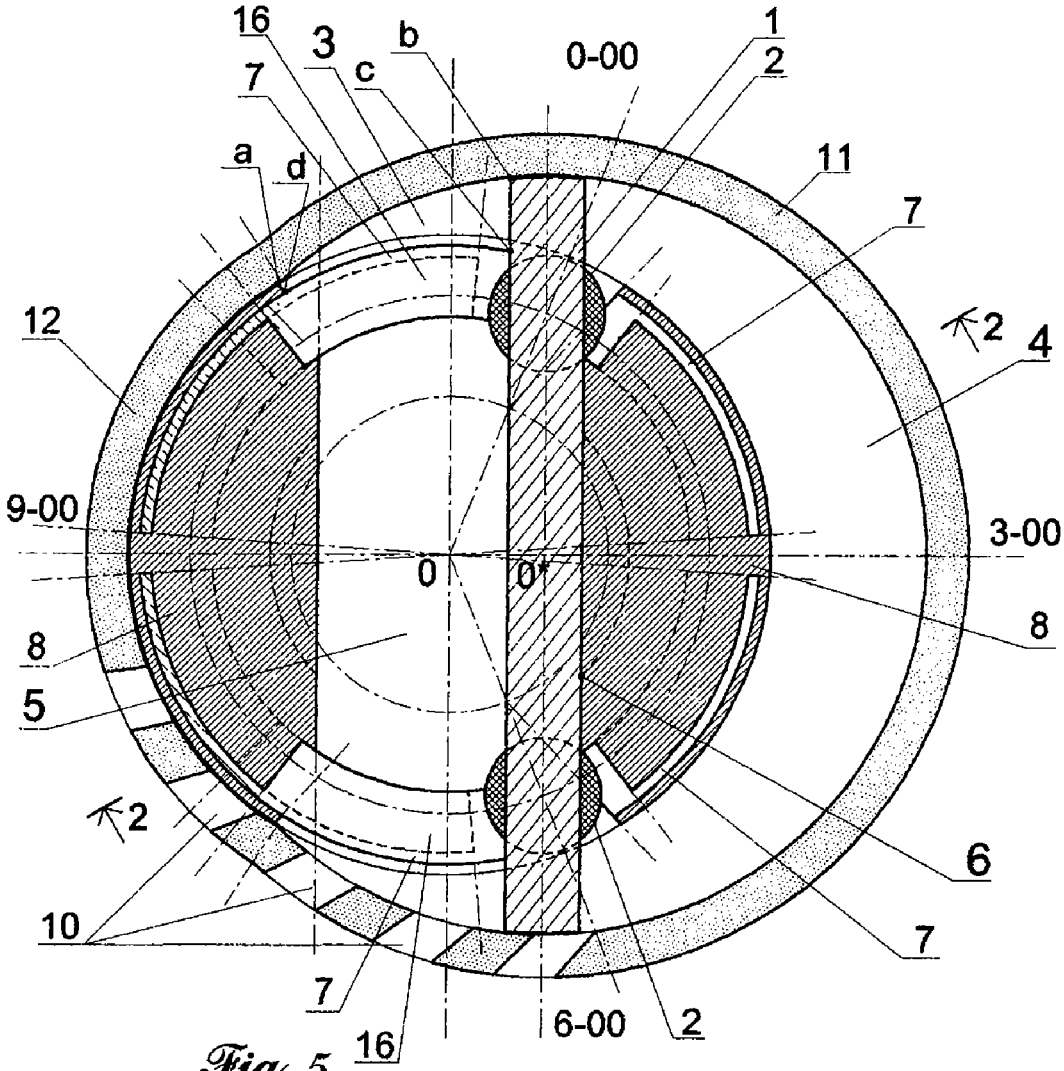
Figure 6:
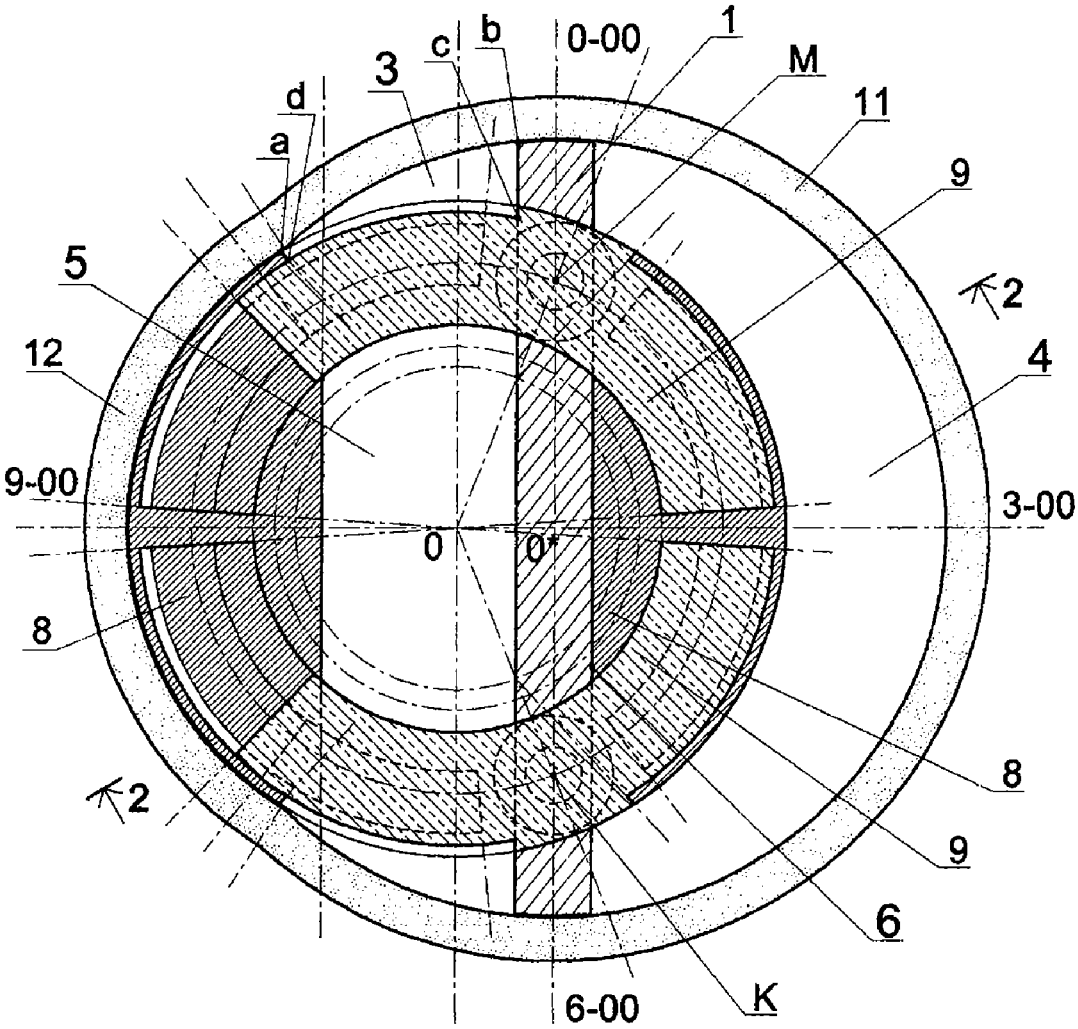
Figure 7:
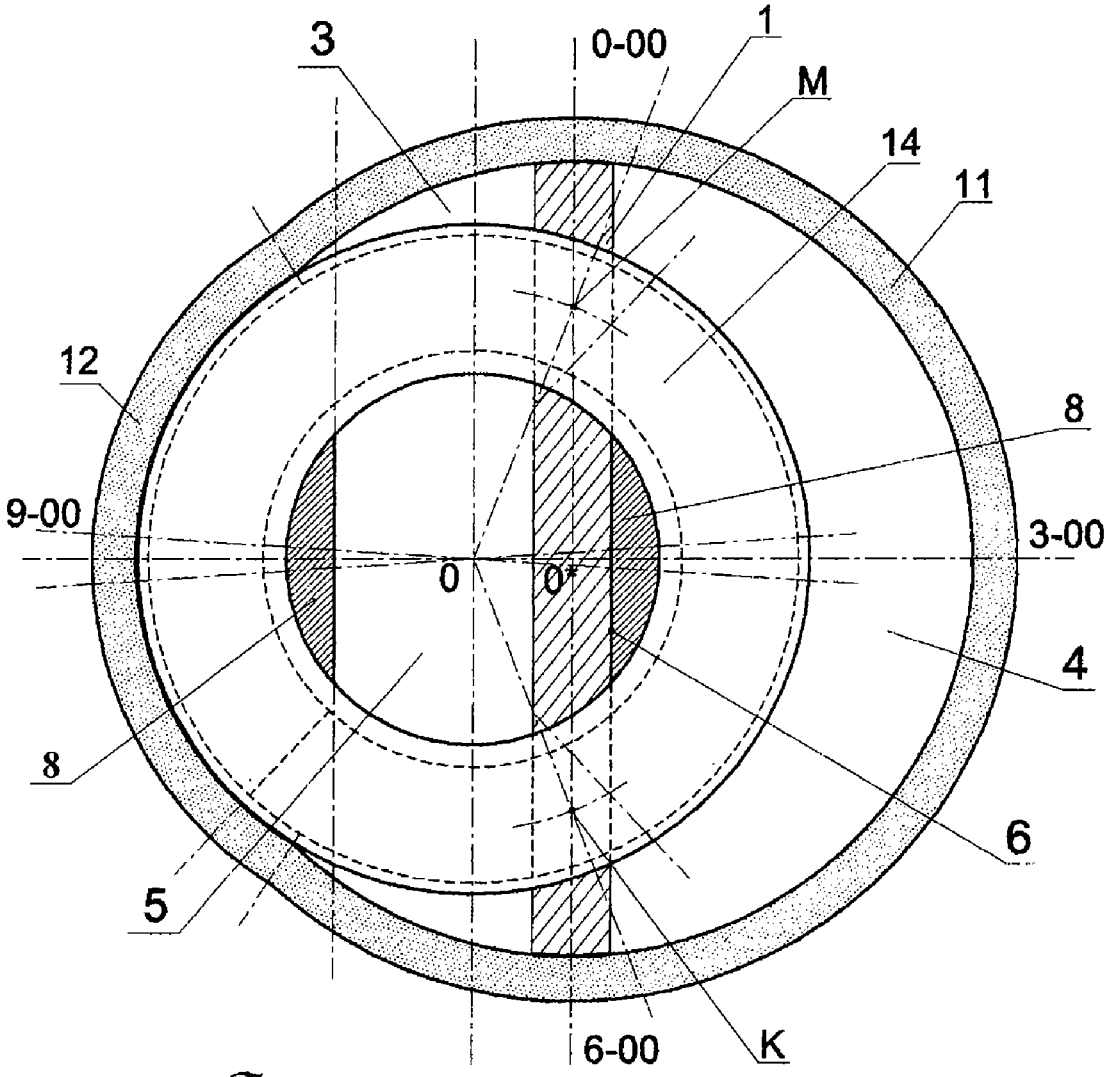
Figure 8:
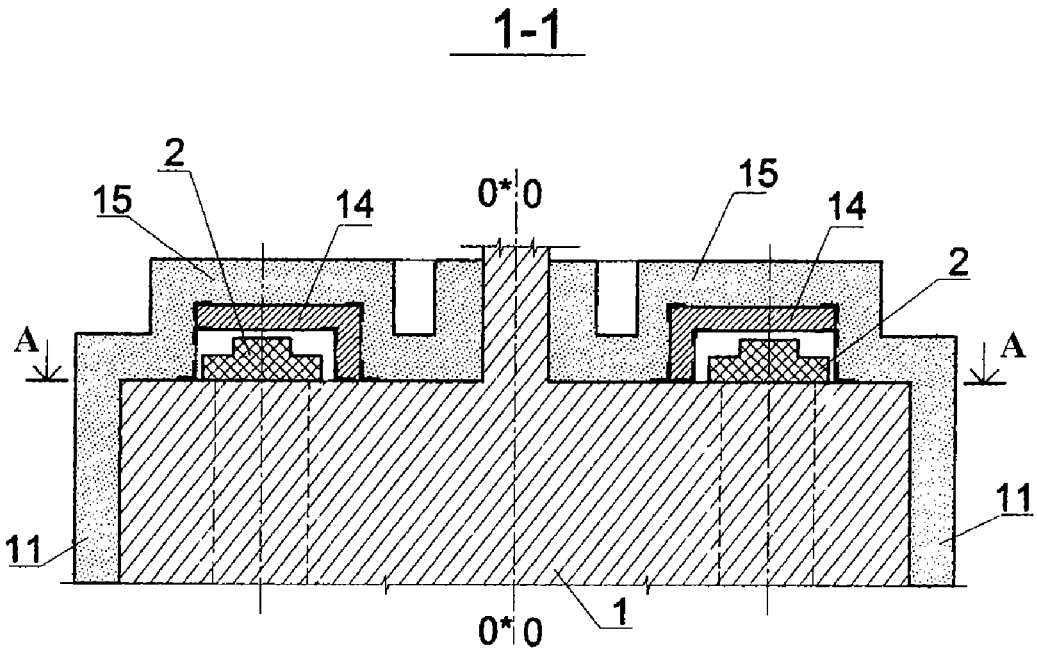
FIGS. 8 and 9 show axial sections across the rotary machine of FIGS. 1 to 7.

A volume-displacement rotary machine, wherein the driving member (axis AA') interacting with a fluid medium (such as air) and transmitting motion rotates in a circular path about a fixed axis 0*, is a continuous-action machine developed for converting compressed medium energy to mechanical energy, or vice versa. The drawings show machine components designated as follows: A rotary machine comprises driving member 1; cylindrical pivotal element 2; main working chamber 3, twin working chamber 4; working fluid compression chamber 5; twin working fluid compression chamber 6; annular rotor elements 7; segmental components (segments) 8 of the rotor; strips 9; purge ports 10; cylindrical portion 11 of the larger-diameter housing; cylindrical portion 12 of the smaller-diameter housing; distinct points "a" and "d" of segment 8; distinct points "b" and "c" of driving member 1, line 13 of possible configuration of compression chambers 5 and 6 in a diesel-powered embodiment of the rotary machine; flange cover 14 of the rotor; flange cover 15 of the housing; reinforcing (cooling) plates 16 of annular element 7; working chamber 17 of the driving member; twin working chamber of the driving member (not shown in FIGS. 10 and 11); one of nozzle orifices 18 for exhaust from driving member 1, with the second orifice not shown in the figure (the orifices are positioned symmetrically about the center of rotation O* of driving member 1); passage 19 for exhaust from driving member 1; twin passage for exhaust from driving member 1 (not shown in the figure); arrows 20 showing movement of the working fluid in driving member 1: chamber 21 to purge working chamber 17 of driving member 1; twin chamber (not shown in the figure) to purge working chamber 17 of driving member 1; valve 22 to discharge working fluid from working chamber 17 of driving member 1 into chamber 3; twin valve as the above valve to discharge working fluid from the twin working chamber (not shown in the figure) of driving member I into chamber 4; valves 23 to inject working fluid into chambers 17 and 21; twin valve to inject working fluid into chambers (not shown in the figure); valve 24 and twin valve, which are intake valves of passage 19; valve 25 to purge chamber 17; twin valve to purge twin chamber; valve 26 to discharge working fluid from chamber 6 into chamber 3; and twin valve to discharge working fluid from chamber 5 into chamber 4.

The claimed rotary machine is a diesel reactive rotor machine with an internal compressor, designated as RMKO1gA.

The RMKO1gA rotary machine has a housing formed by two intersecting cylinder parts 11 and 12 of different diameters having parallel axes O (smaller-diameter cylinder) and O* (larger-diameter cylinder). A rotor received in the housing is in line with the smaller-diameter cylinder 12 and consists of several components.

In the first embodiment of the RMKO1gA rotary machine, the rotor consists of at least two segmental components (segments) 8 and at least two pairs of annular (annular sector) elements 7. FIGS. 1-7, 12, 13, and 20-25 illustrate an embodiment having two segmental rotor parts 8 and two annular elements 7. Segmental rotor parts 8 in the embodiment of FIGS. 1-7 are fastened together at the ends by circular rotor covers 14 or made integrally therewith.

Each pair of annular elements 7 is fastened at the ends with strips 9 or is made integrally with them and has its end portions received in annular guides (recesses) of rotor covers 14.

Cylindrical pivotal elements 2 are placed between annular elements 7 of each pair. The pivotal elements 2 have their ends inserted into the openings (or recesses) of strips 9 to be freely pivoted therein, for example, via rolling-contact bearings.

Pivotal elements 2 have orifices (slits) of a shape complementary to the shape of driving member 1 slidably received therein. Driving member 1 has an axis of rotation coincident with axis O* of the larger-diameter cylinder, and also has wide parallel working surfaces and narrow rounded (cylindrical) working surfaces in contact with the inner surface of larger-diameter part 11 of the housing. Also, the radius of curvature of these rounded portions is larger than the distance from center O of rotor rotation to pivotal elements 2.

Segmental elements 8 and annular elements 7 can be positioned differently relative to, and can interact differently with, one another.

FIGS. 1 to 7 illustrate a rotary machine design, in which the pairs of annular elements 7 move in the annular guides of segmental elements 8 and push the same in rotation, segmental elements 8 being in contact with the cylindrical surface of smaller-diameter part 7*b* of the housing.

Figure 12:
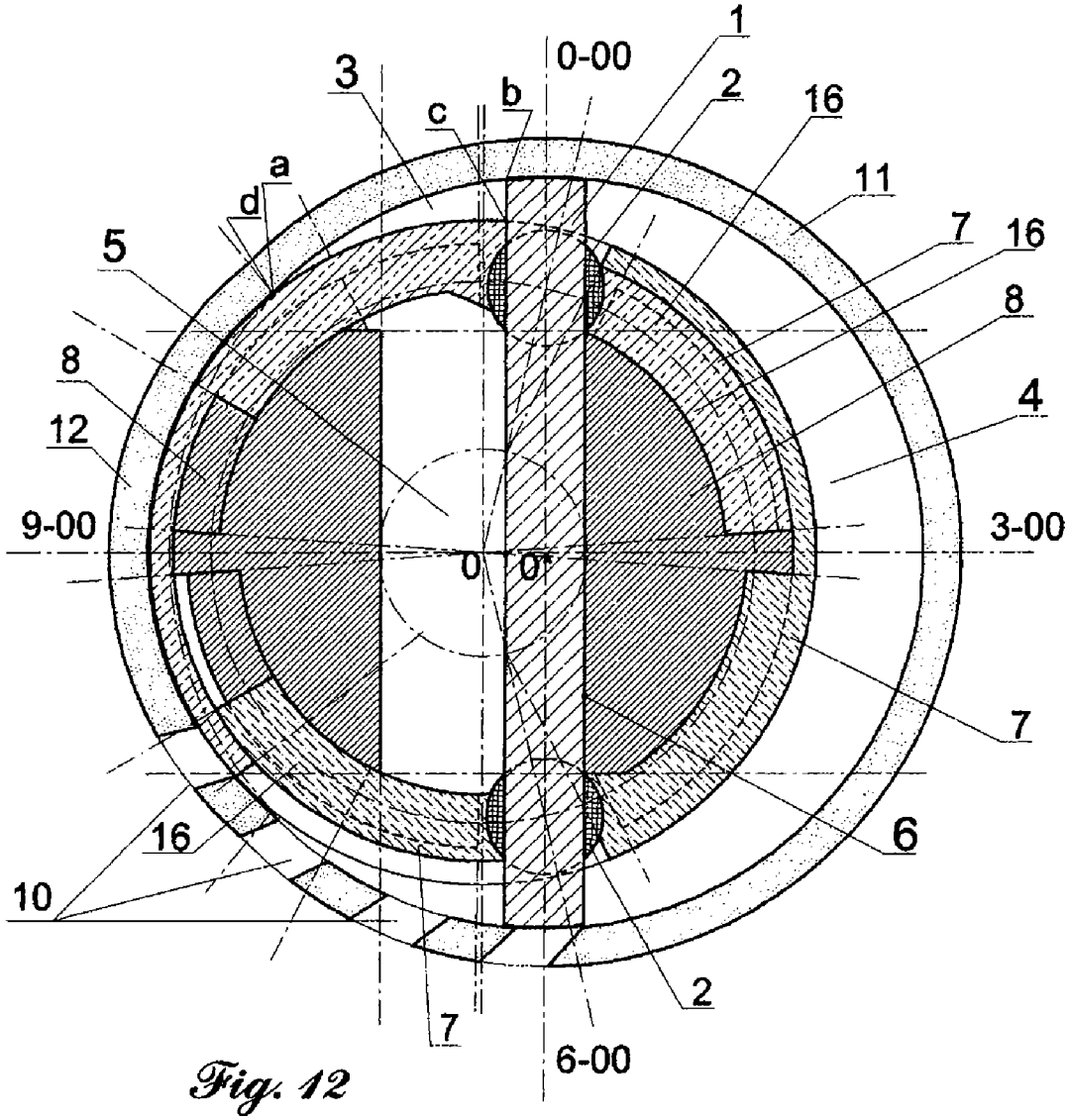
FIGS. 12 and 13 show relative positioning of rotary machine elements with rotor segments embraced by annular elements movable in the annular guides of the rotor segments.
Figure 13:
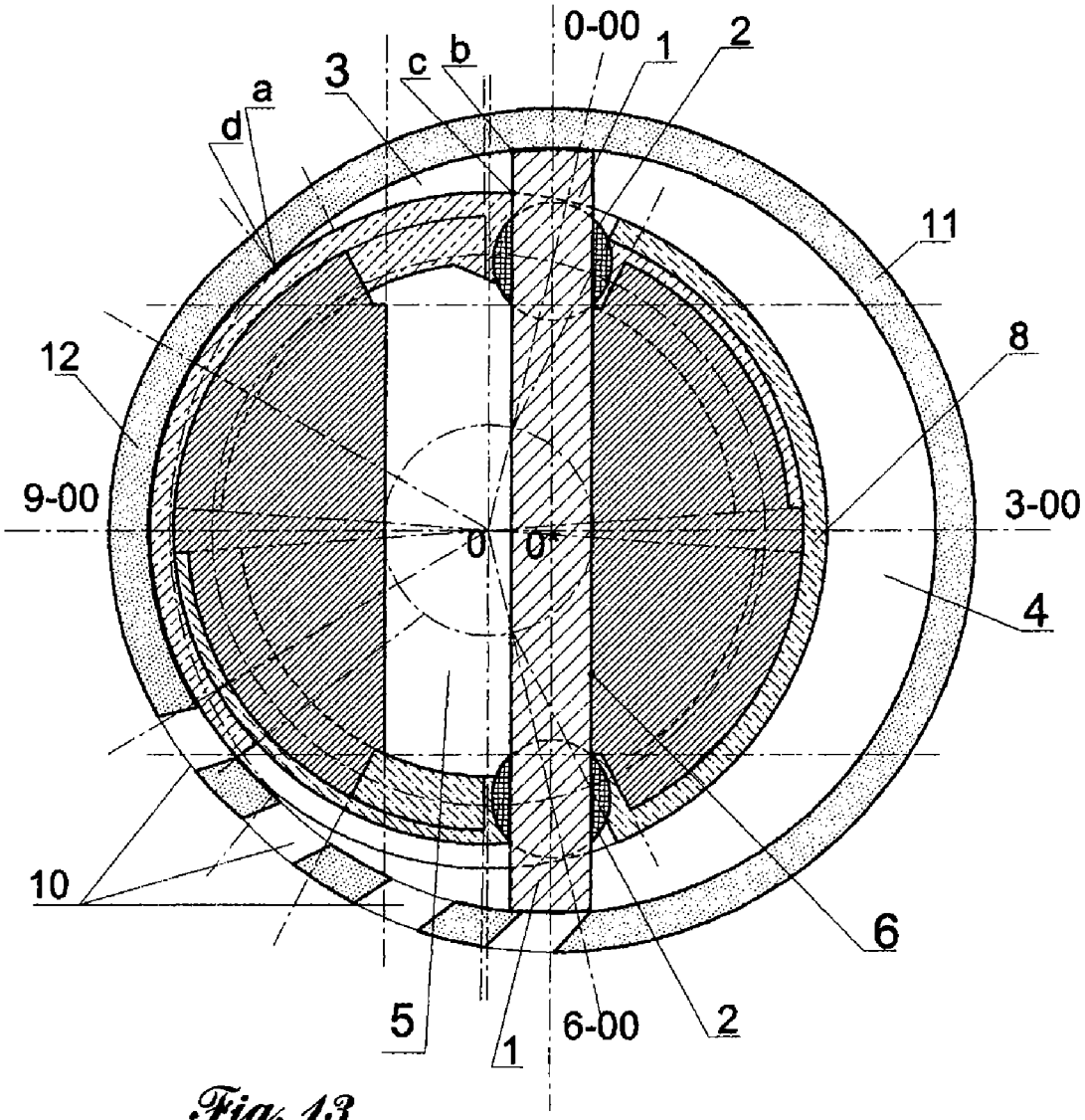
Figure 14:
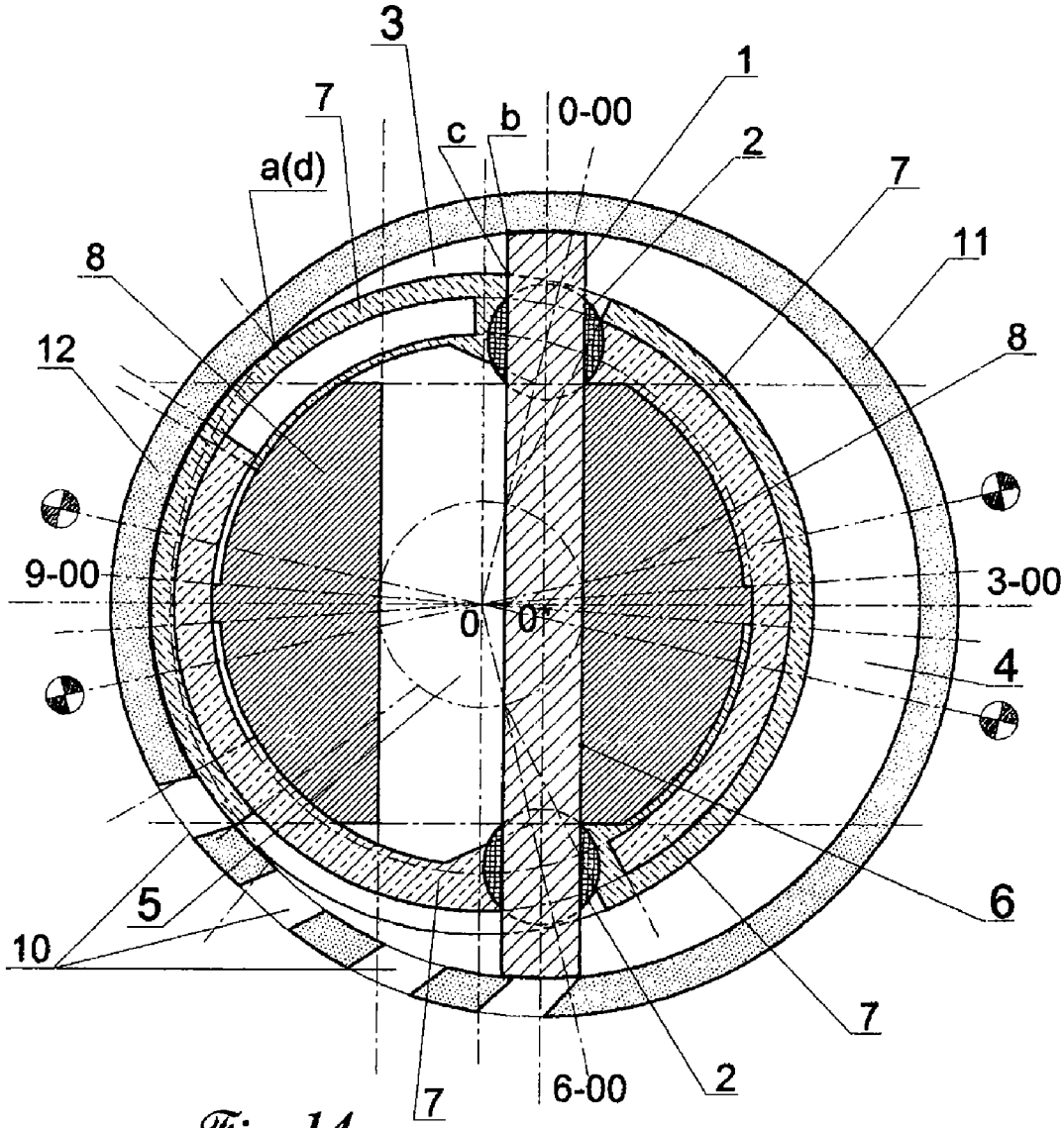
FIGS. 14 to 18 show relative positioning of rotary machine elements with rotor segments embraced by annular elements moving in annular guides of one another.
Figure 15:
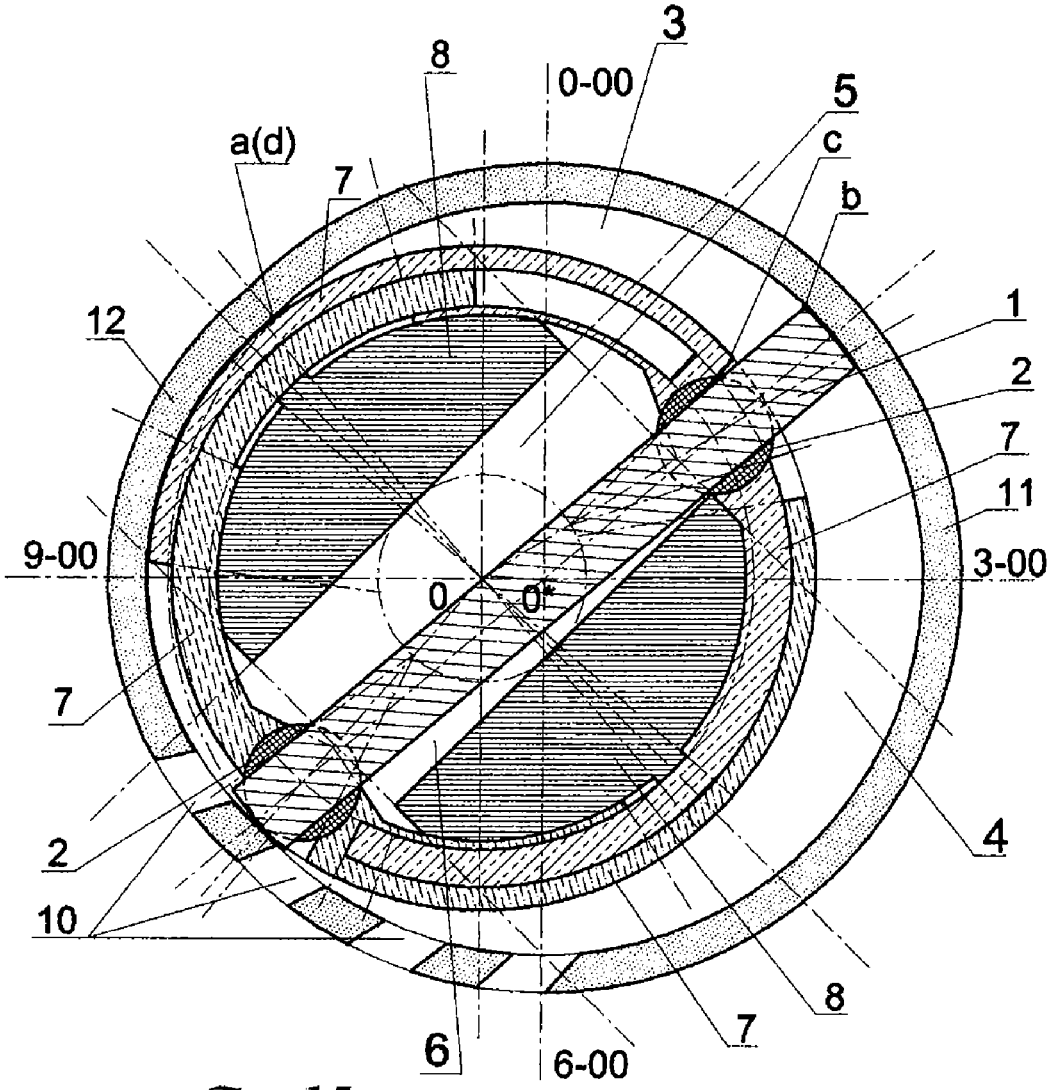
Figure 16:
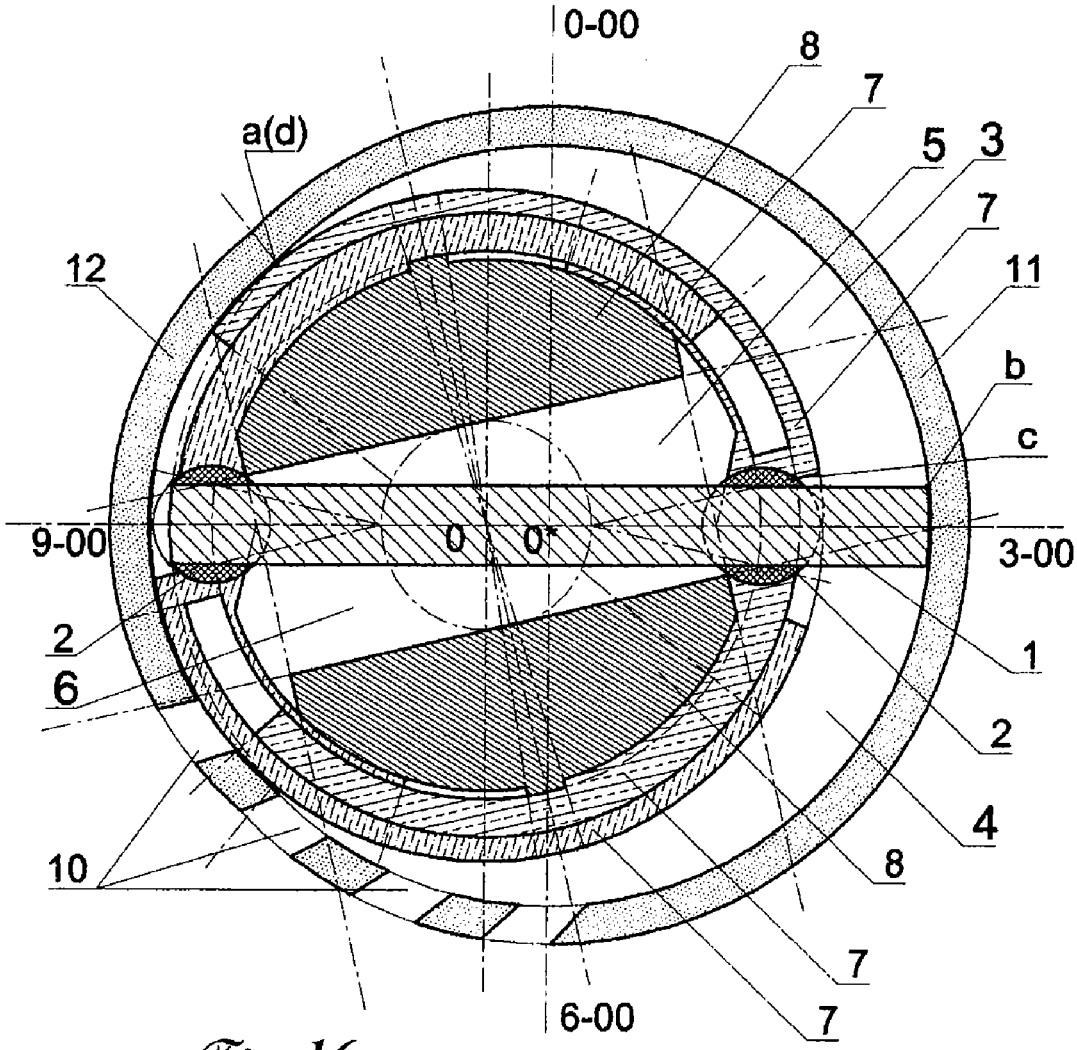
Figure 17:
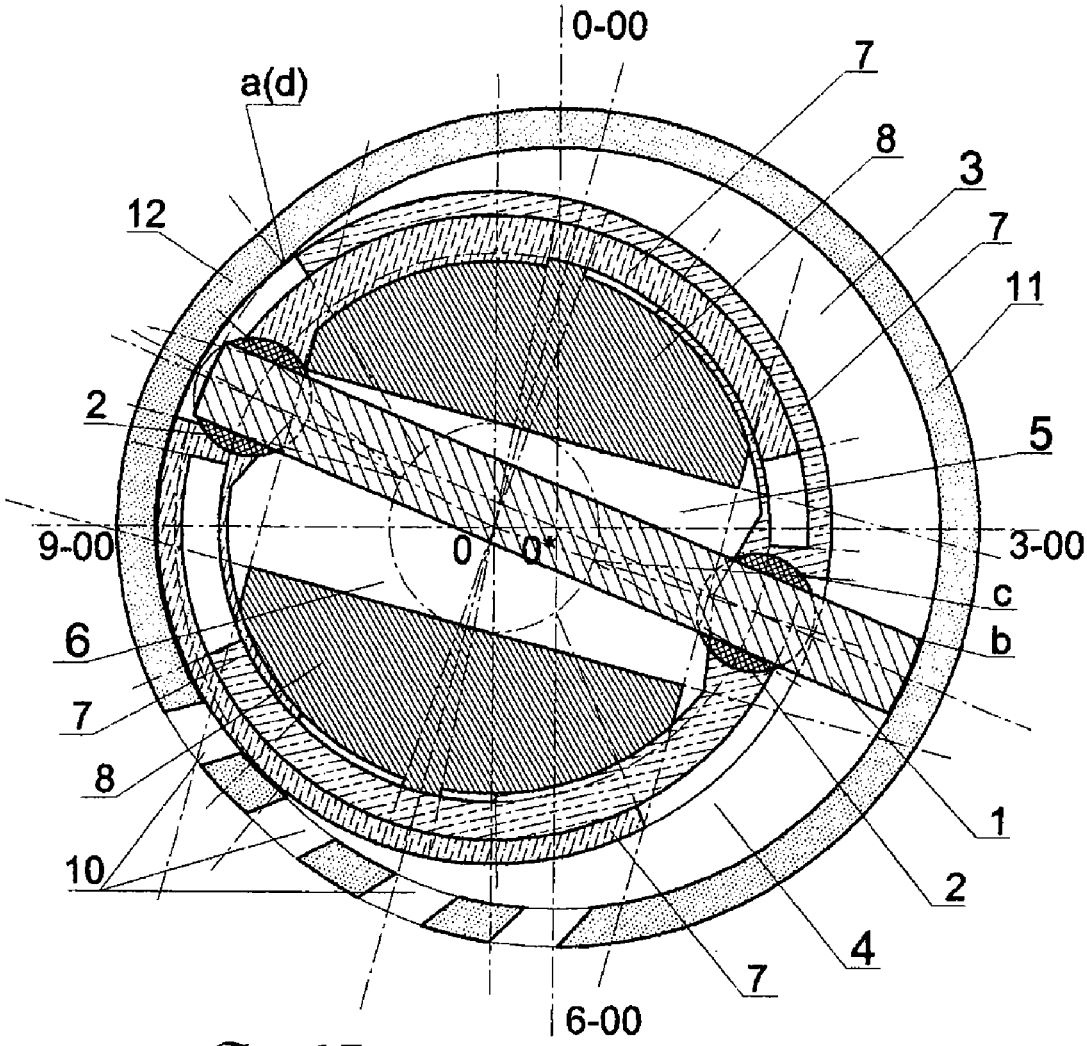
Figure 18:
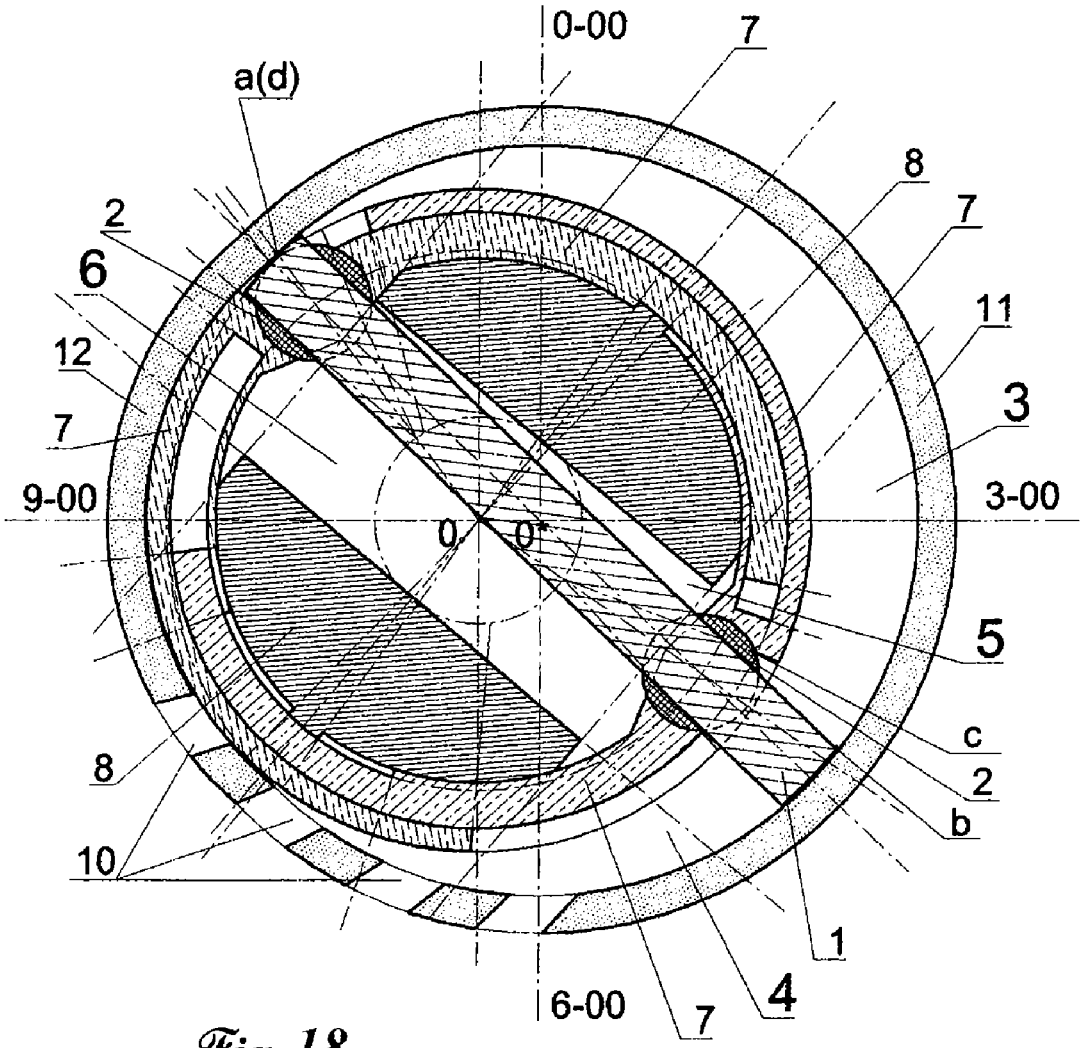
Figure 19:
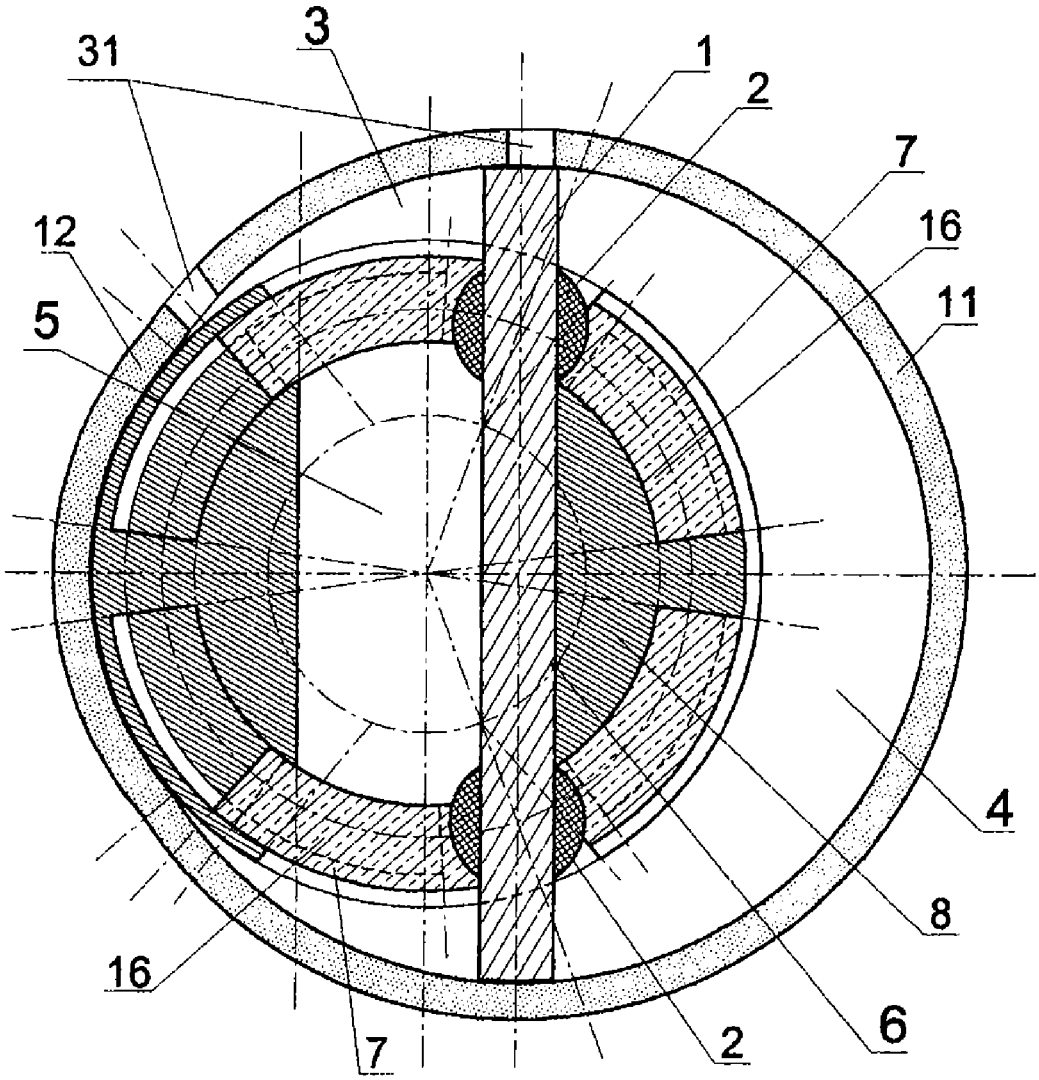
FIG. 19 shows the rotary machine operating as a pump.

FIGS. 12 and 13 illustrate a design, in which the pairs of annular elements 7 also move in the annular guides of segmental elements 8 to engage the same in rotation, but annular elements 7 embrace segmental elements 8 and stay in contact with the cylindrical surface of smaller-diameter part 12 of the housing.

FIGS. 14 to 19 illustrate a design, in which annular elements 7 embrace segmental elements 8, in the manner of the preceding design, but annular elements 7 move in the annular guides of one another.

Figure 20:
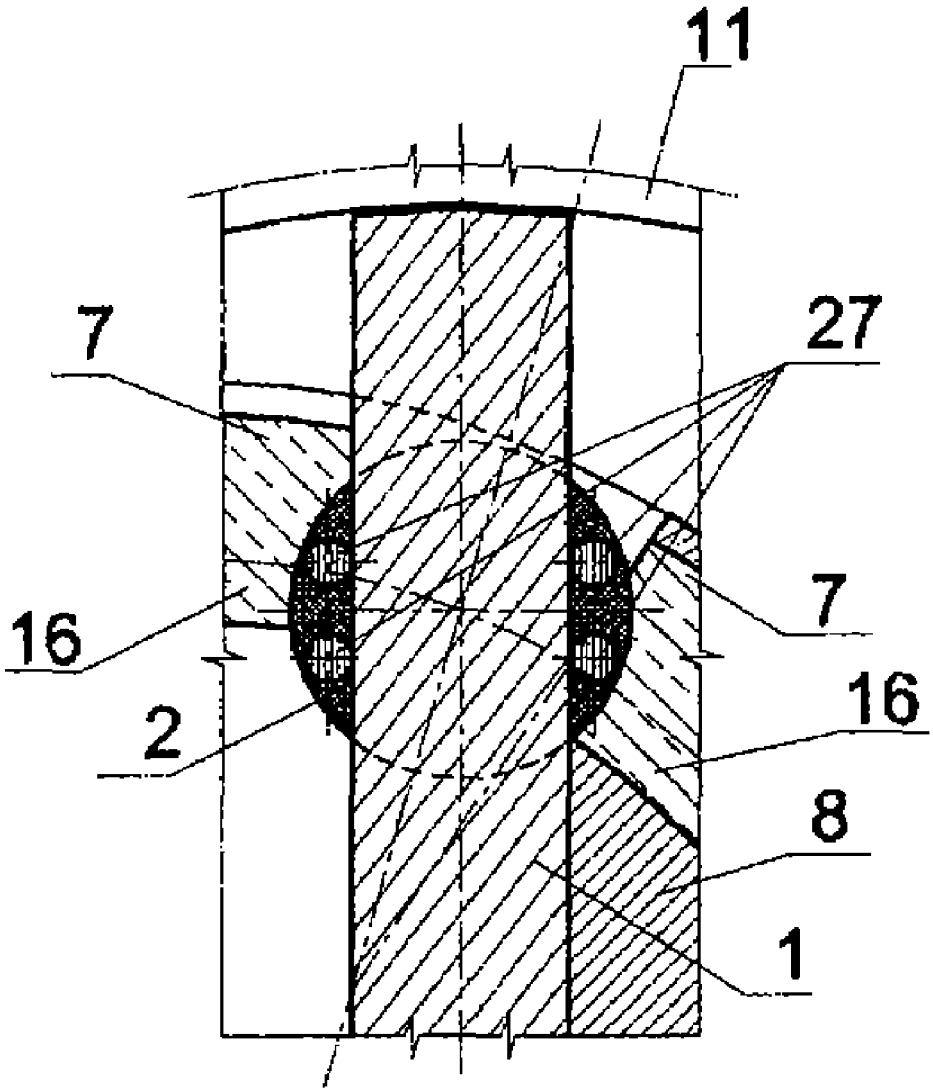
FIG. 20 shows pivotal elements provided with rolling-contact bearings.

To reduce friction losses, rolling-contact bearings (for example, as shown in FIG. 20) are provided in the slits of pivotal elements 2, on the surfaces of the annular guides of segmental elements 8, annular elements 7, rotor covers 14, and on the end-face surfaces of the housing.

Figure 9:
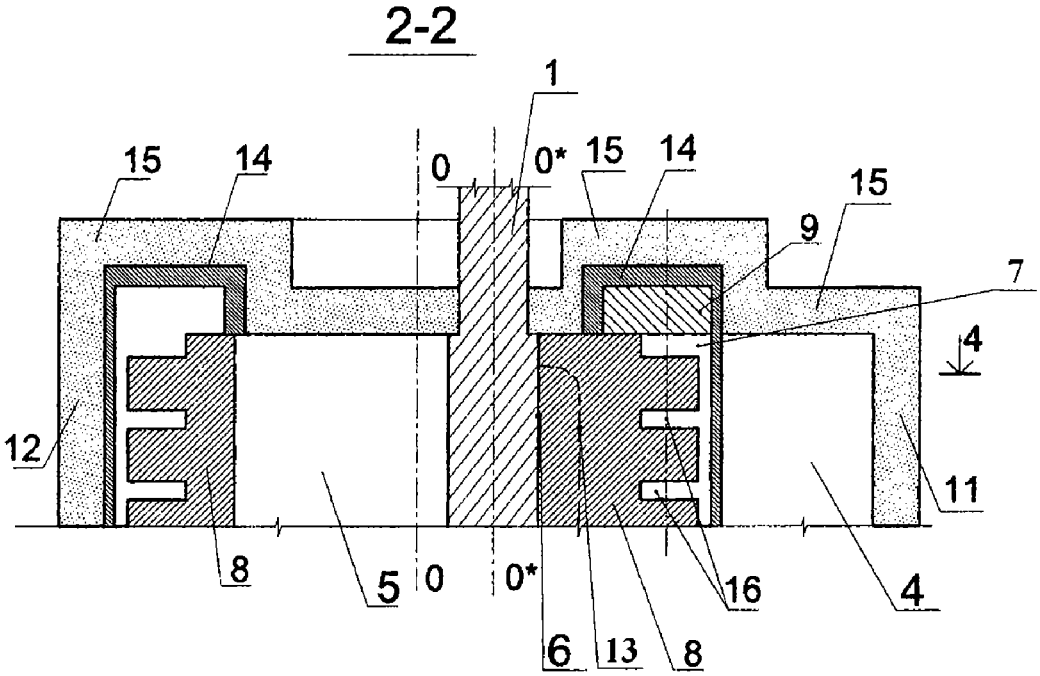

Annular elements 7 are provided with reinforcing and cooling plates 16 (as in FIG. 9). The machine housing has passages for circulating a coolant.

Figure 22:
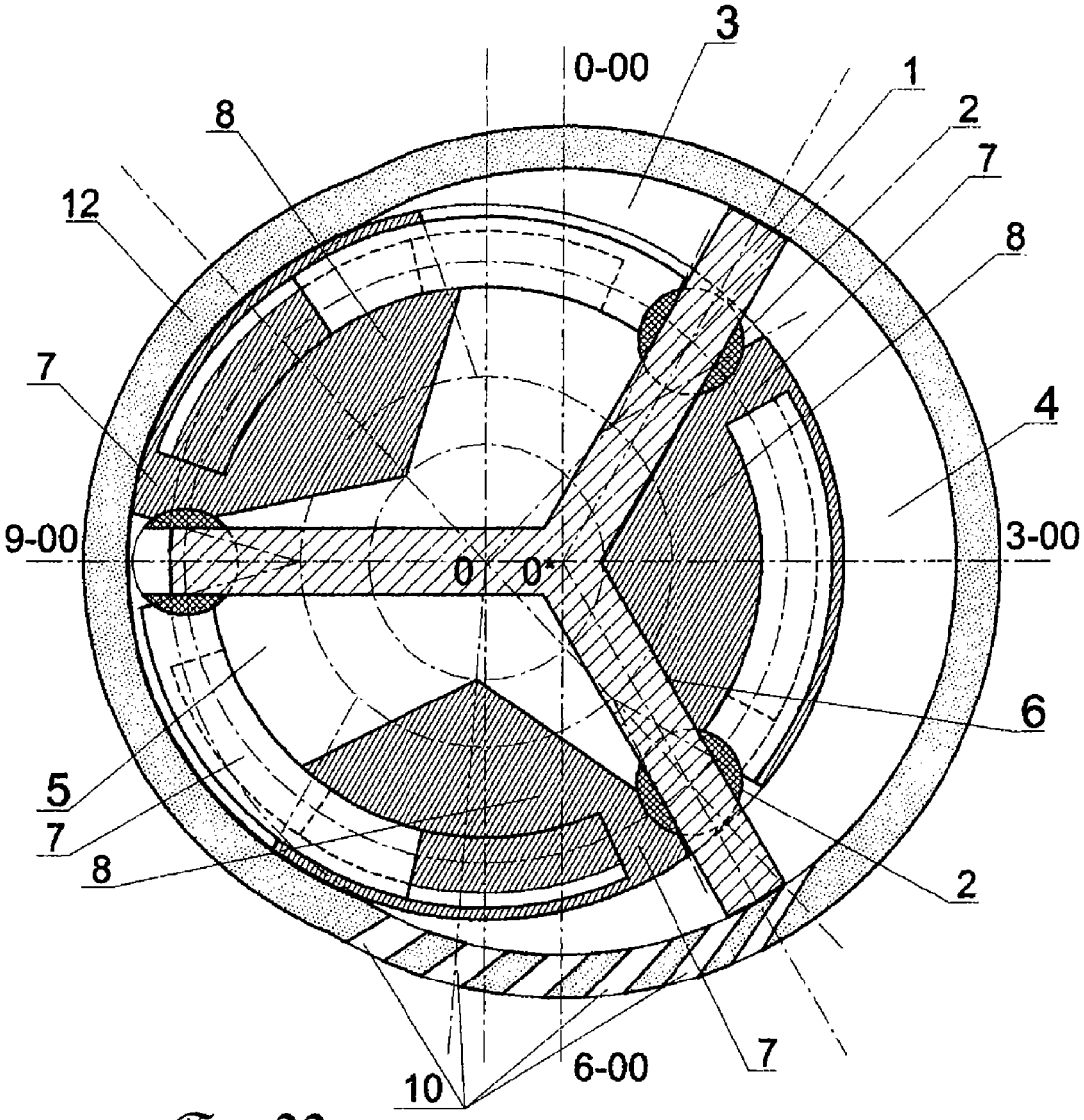
FIG. 22 shows an embodiment of a rotary machine provided with a three-lobed driving member and three rotor segments.
Figure 23:
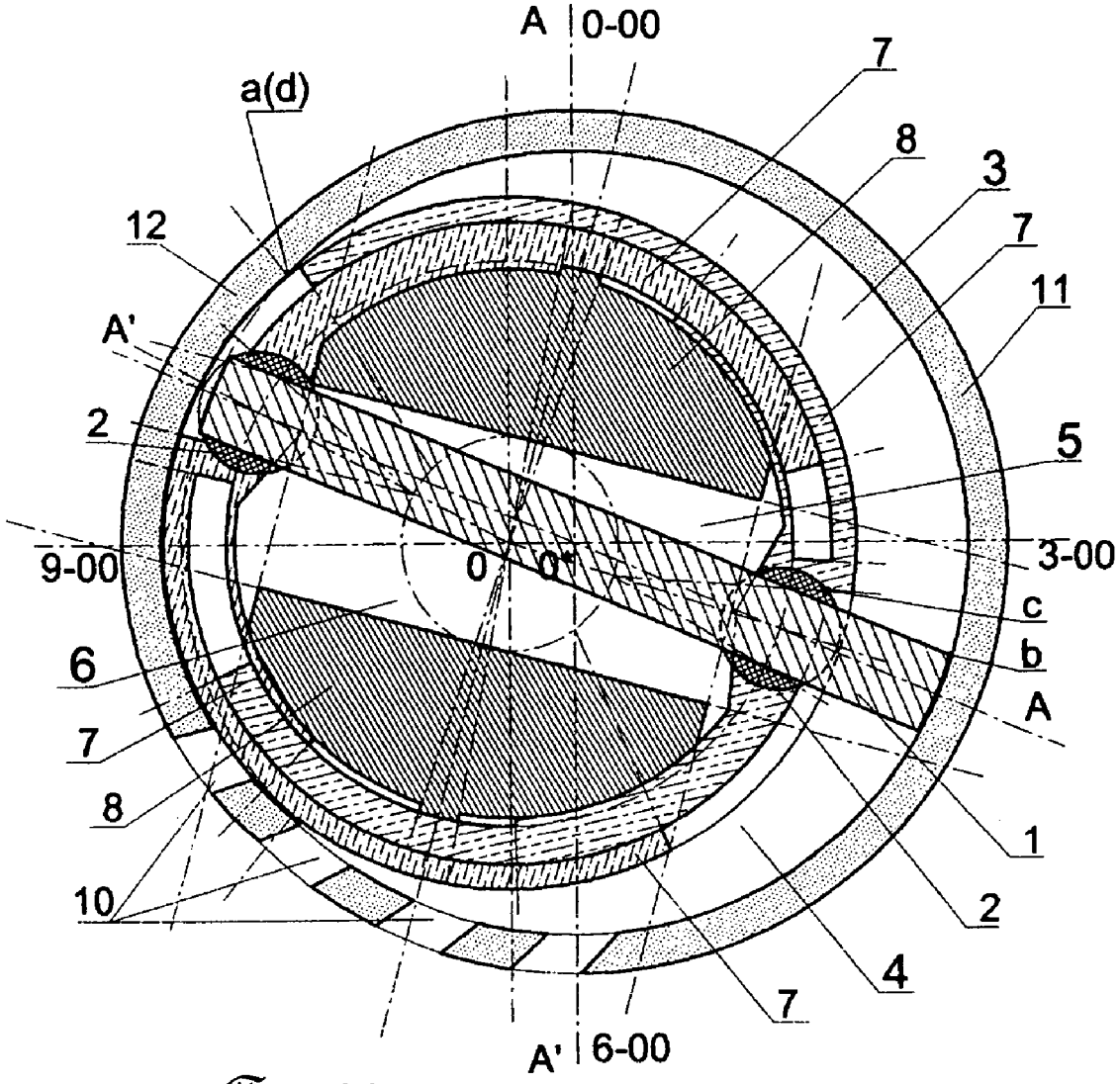
Figure 24:
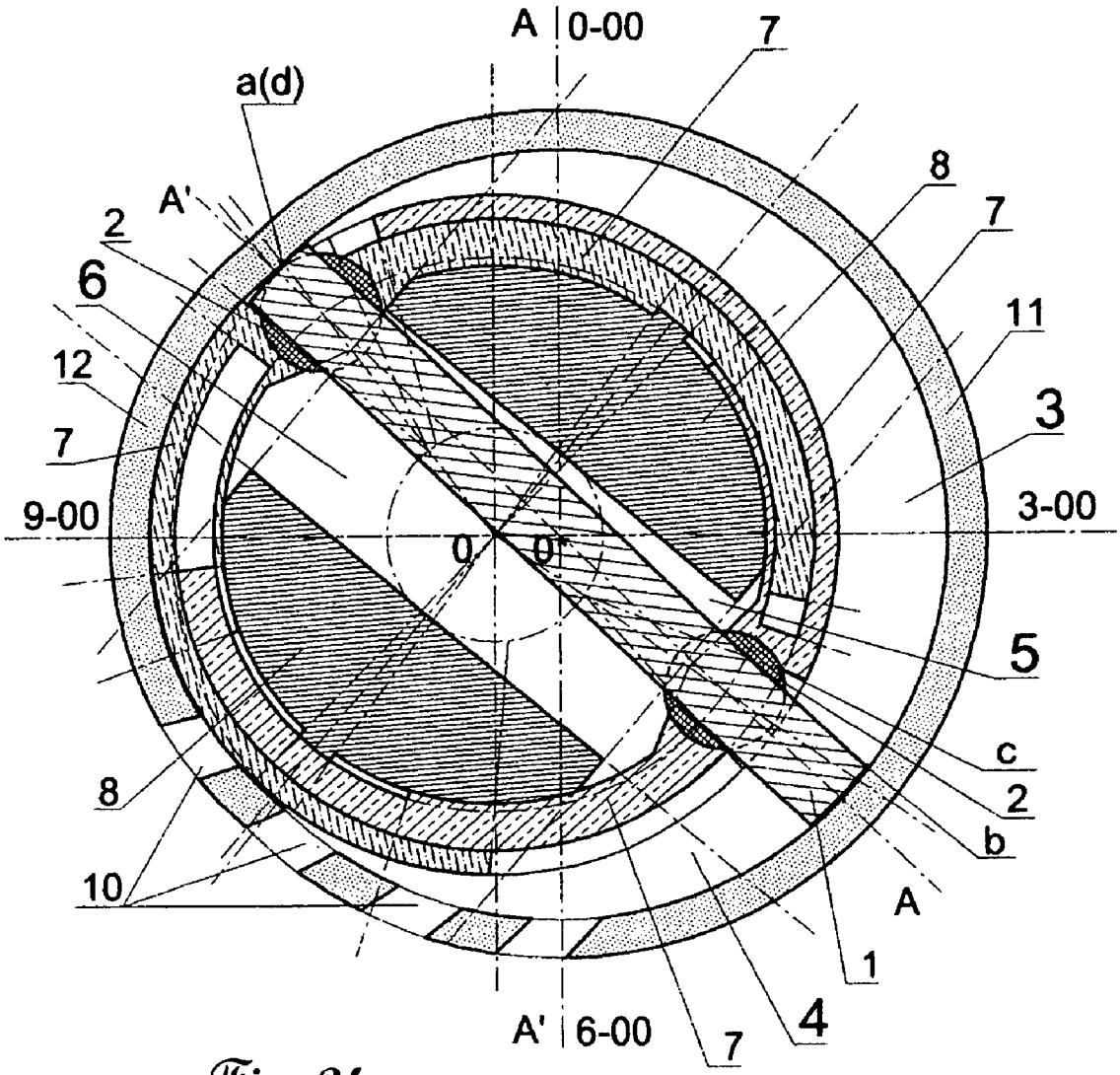
Figure 25:
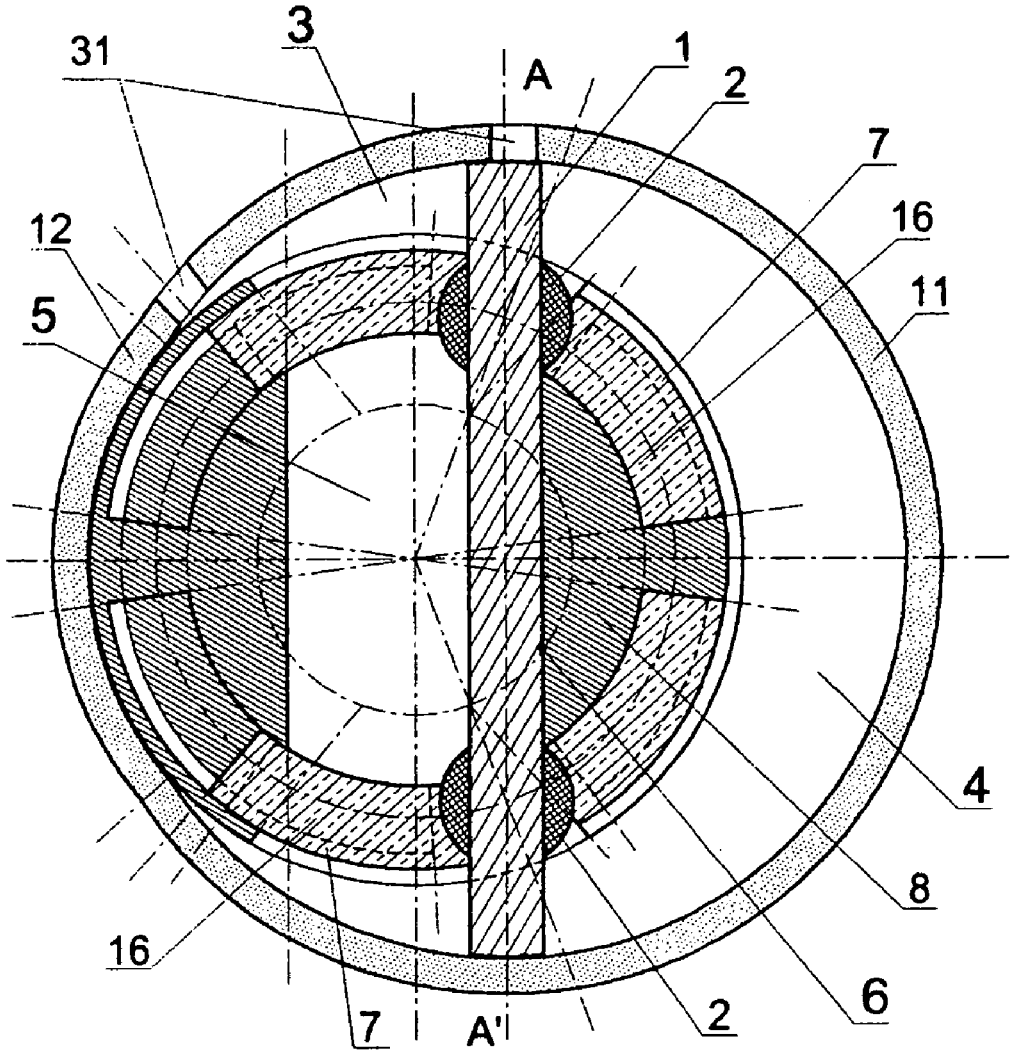

Driving member 1 may be a single plate (FIGS. 1 to 7, 12, 13, and 14 19) or be composed of several plates interconnected at the axis of rotation (FIG. 22). In each case, it has a two-, three- or multi-lobed configuration in cross-section. A simple single plate is, therefore, a driving member of a "two-lobed" type, with an angle of 180° between the lobes radiating from the center 0*, that is, the lobes lie on a single line.

In a driving member made up of three plates; the angle between each two lobes is equal to 120°. This is a "three-lobed" rotor (FIG. 22).

A "four-lobed" driving member consists of four plates spaced at angles of 90° between each two plates (lobes), and so on.

Moreover, the machine rotor has a respective number of segmental parts (elements) 8. In the case of a two-lobed driving member, the rotor has two segmental elements with a flat working surface (FIG. 1). Where the driving member has three or more lobes, the rotor has three or more segmental elements 8, a segmental element having a two-sided working surface (FIG. 22) and the angle between the sides being equal to the angle between the lobes. With each segmental element 8 placed between the respective plates of driving member 1 and the above angles being equal, contact is maintained between driving member I and the working surfaces of the segmental elements upon rotation of driving member 1.

The claimed rotary machine can use a driving member consisting of a single solid plate or more plates. It can, however, use several driving members of composite design. Moreover, a driving member of a design described below can be used in other rotary machines as well.

The driving member (FIG. 10) consists of a housing, each part of which comprises communicating inner chambers between the axis of rotation 0* and a narrow working surface designed to be in contact with the inner surface of the rotary machine housing, in particular, working combustion chamber 17 and purging chamber 21. Valves 23 are provided to inject a working fluid into chambers 17 and 21. Passage 19 with valves 24 is provided in each said housing part for discharging the working fluid from driving member I through nozzle-like outlet opening 18.

Figure 21:
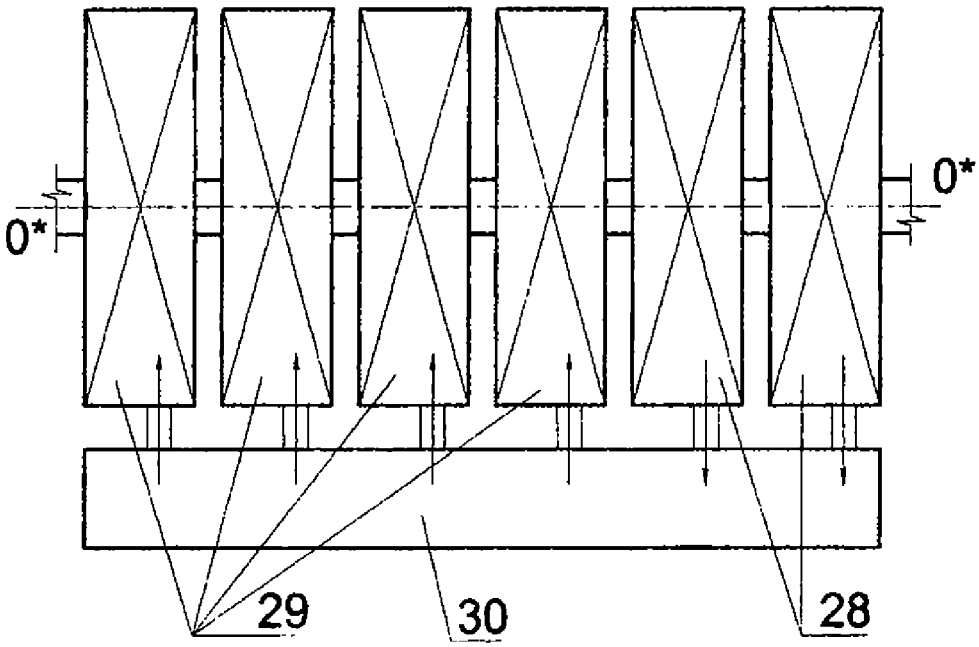
FIG. 21 shows an engine plant using rotary machines as claimed herein.

The claimed RMKO1gA rotary machine can be used as a basic component of an engine plant shown diagrammatically in FIG. 21. The engine plant comprises one or more rotary machines 28 operating in a pump mode and one or more rotary machines 29 operating in an engine mode. The outlet of rotary machines 28 operating as pumps is connected to receiver 30 that is, in turn, connected to working chambers 3 and 4 or 5 and 6 of engine-mode rotary machines 29. Direct connection, without using a receiver, can be effected as well. Operation of an engine plant is described below.

Operating Principle of the RMKO1gA Rotary Machine

The claimed rotary machine using energy produced by combustion of a fuel mixture (such as air-gas, air-gasoline, air-diesel fuel or other combinations of fuel and oxidizer) operates as follows.

High pressure produced alternately in chambers 3 and 4 by gases evolving upon combustion of, for example, a gasoline-air mixture rotates driving member 1 continuously because all essential events, in particular, air suction, air (mixture) compression, mixture combustion causing a high pressure to be built up concurrently in chamber 3 (or 4) (in certain designs, in chambers 5 and 6 and within driving member 1 itself), purging of chambers 3 and 4 or 5 and 6, chambers 17, and passages 19, and exhausting combustion products alternately from the driving member, are completed separately from one another over each 1800 of rotation of the driving member (from position of working member 1 at 0:00 hours to position at 6:00 hours). Certain designs of the claimed rotary machine, in particular, a design, in which the mixture is fired alternately in working member 1 or in chambers 5 and 6, are a machine utilizing further the reactive component of a torque produced by the flow of working fluid (combustion products) from nozzle-like exhaust orifices 18 of driving member I alternately to working chambers 3 and 4.

When the RMKO1gA rotary machine is used as a pump to compress air or other fluids during rotation of driving member 1 together with the rotor, chambers 3-6 are used as a compressor pump with two compression stages, air is first compressed alternately in chambers 3, 4, whereupon it is transferred through annular elements 7 for successive alternate compression in chambers 5 and 6. At the end of the compression cycle, as pressure reaches the required level, air (working fluid) is transferred for further utilization in the receiver (if it is used) through the end-face covers or other elements.

Areas of Application of the Claimed Rotary Machine

The claimed rotary machine can be used in the following fields:

Engine building;

Pneumatic, hydraulic and pumping units;

Power engineering, and so on.

FIGS. 1-4, and 14-19 illustrate the positions of the principal elements of the rotary machine in operation, with the driving member turning through 180 degrees. Further rotation occurs as described hereinbelow.

Description of the Rotary Machine Operating as an Engine

The claimed rotary machine utilizes energy released upon combustion of a fuel mixture (such as air-gas, air-gasoline, air-diesel fuel, and other fuel and oxidizer combinations).

The RMKO1gA rotary machine operates on the principle of volume expansion (displacement) of working fluid by driving member 1 to chambers 3, 4, 5 and 6 and generation of torque every 180 degree turn of the driving member (from position 0:00 to position 6:00), when the following processes occur.

Figure 10:
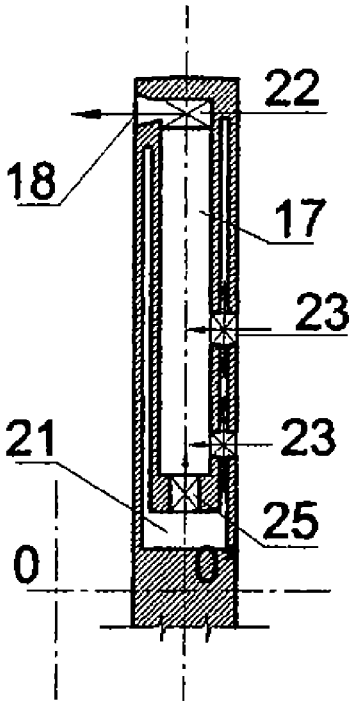
FIGS. 10 and 11 show sections across the driving member of the rotary machine.
Figure 11:
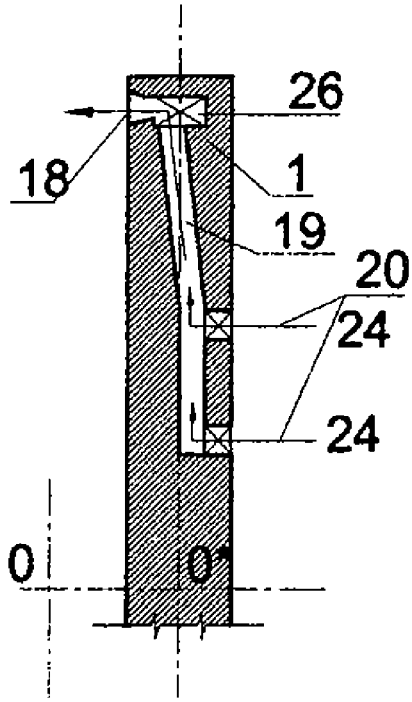

Working fluid is compressed in chambers 5 (or 6) during rotation of driving member 1 starting from position 0:00 (side A of the driving member) to position 6:00 (side A' of the driving member), when at the same time working fluid is drawn into twin chamber 6 (or 5) (as shown in FIGS. 1-4, and 14-19). After the working fluid has been compressed in chambers 5 and 6 alternately during rotation of driving member 1, the process develops as follows, according to embodiments:

a. When driving member 1 reaches a position at approximately 17:00 (11:00) (after driving member 1 has passed the inflection line, or the common generatrix of the cylindrical parts 11 and 12 of the housing; in FIG. 1 this is a point coincident with the point "a"), chamber 3 (or 4) starts to be filled via valves 24, discharge passage 19, and valve 25 (FIG. 11), the process being completed with driving member 1 in position at 0:00 (6:00).

b. Compression of the working fluid during rotation of driving member 1 from 0:00 to 6:00, causes the fluid to flow, via valve 22, into chambers 17 and 21, respectively (FIG. 10).

Figure 27:
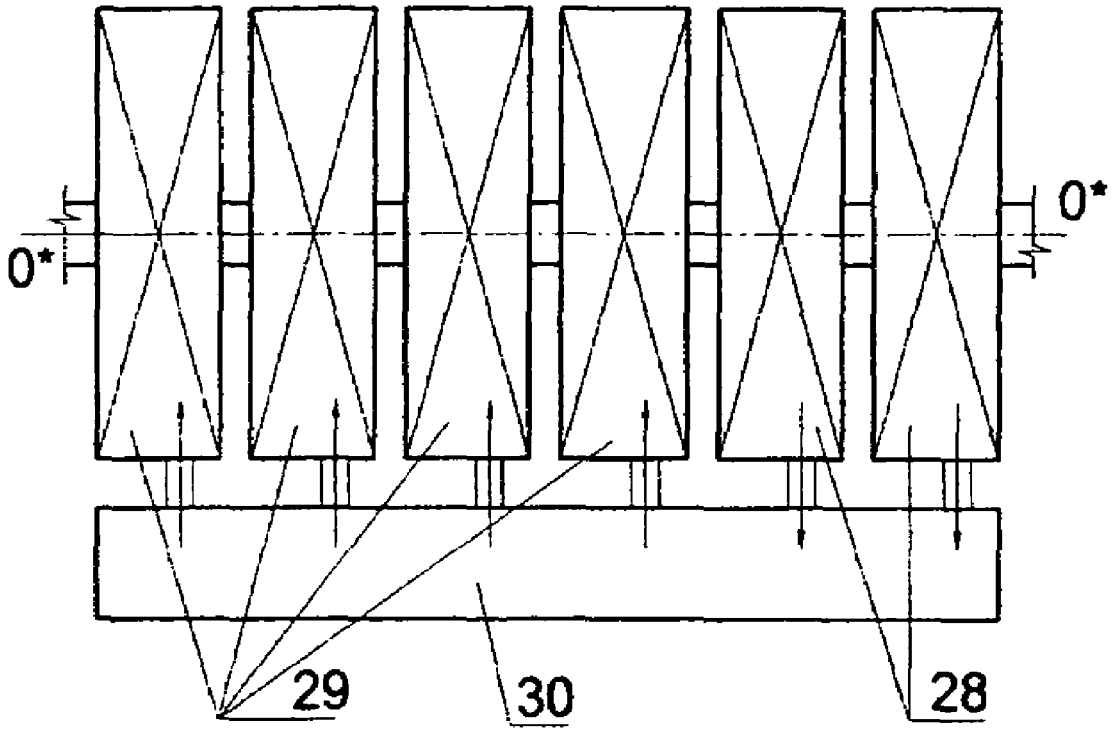
Figure 28:
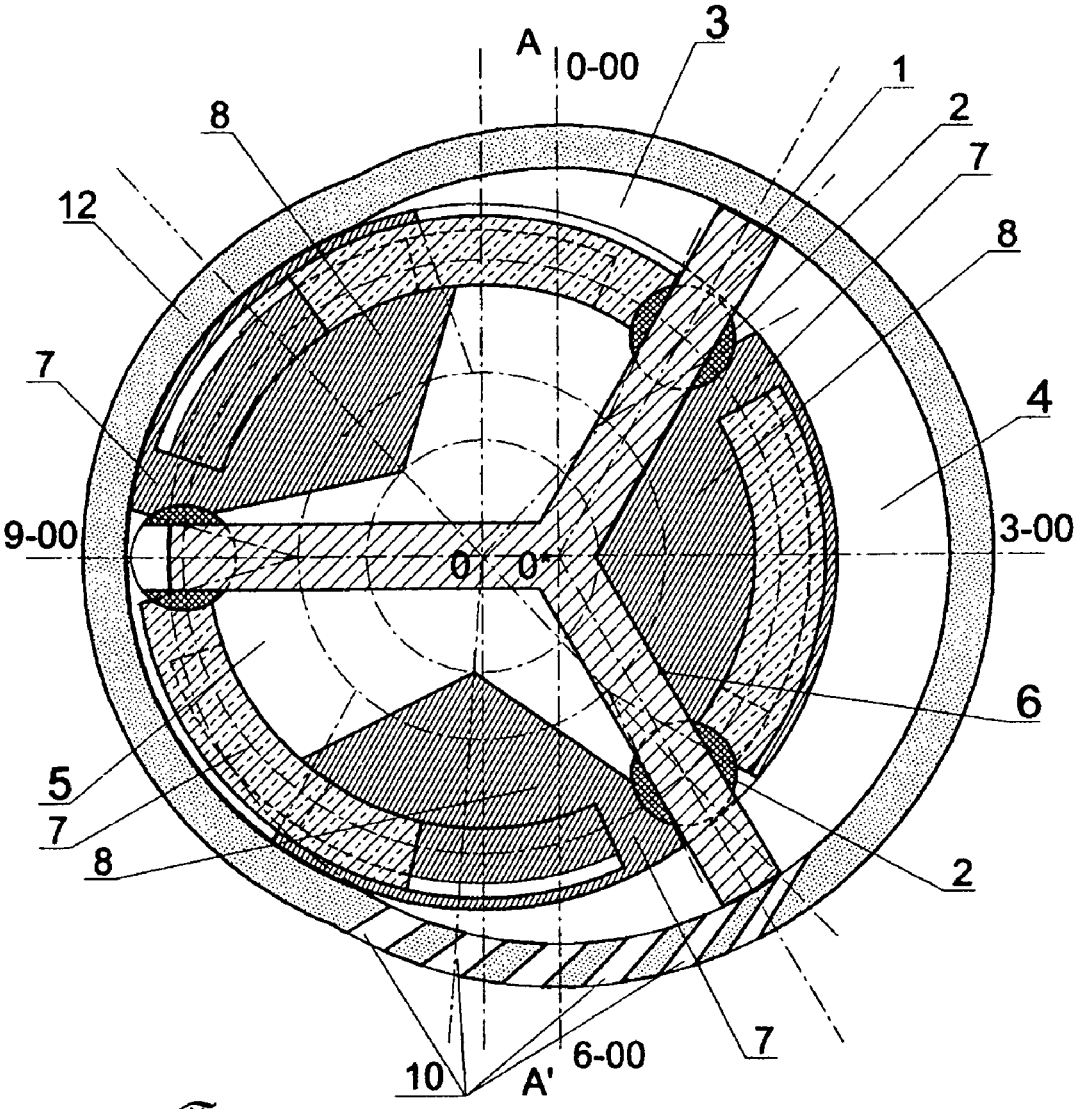

Note: Driving member 1 contains twin chambers 17 and 21 (FIG. 10), each pair in its respective arm (along the radii from the center of rotation). Each pair has double walls for the surrounding air, which is subsequently used to purge it, to absorb excess heat of the hot walls of the working chamber itself;

c. Compression of the working fluid during rotation of driving member 1 from position 0:00 to position 6:00 results in the formation of chamber 5 (or 6), shown by dotted lines at 8 in FIG. 1, the volume and shape of which may vary (for diesel fuel), depending on additional equipment and the effect of other factors; and d. Compression of the working fluid during rotation of driving member 1 from position 0:00 to position 6:00, causes the fluid to flow through end-face covers 15 into common receiver 30 (FIG. 27), whence the working fluid saturated with fuel in the process flows, when necessary in required quantities and under required pressure, into chamber 3 (or 4).

Fuel is injected, according to embodiments, as follows:

a. Fuel is injected into the compressed working fluid in chamber 3 (or 4), after chamber 3 (or 4) started to be filled from injectors, such as those provided in housing part 11 (above chamber 3 in FIG. 1) (following the passage of driving member 1 across the inflection line, or the common generatrix of cylindrical housing parts 11 and 12; in FIG. 1, it is coincident with point "a");

b. Fuel is injected into the compressed working fluid in the working chamber 17 of the driving member 1 (or twin chamber), after or as during the period when the working fluid fills this working chamber 17;

c. Fuel is injected into the compressed working fluid in chamber 5 (or 6), beginning with the start of compression (FIG. 1), into chamber 5 (or chamber 6), before ignition, with driving member I positioned at 0:00 (in a gasoline-fueled embodiment of the rotary machine), or directly into the smaller chamber (with driving member 1 positioned at 0:00) shown by interrupted line 13 in the diesel-fueled embodiment of the rotary machine.

Note: The shape and volume of the chamber are shown by interrupted line 13 (FIG. 1) conventionally. The shape and volume of the chamber can be modified for a diesel-fueled embodiment, and have a smaller size and a different shape of segmental elements 8 along the surface of contact with driving member 1 and end-face covers 14 and 15, depending on degree of compression and other factors; and d. Fuel is injected outside of the rotary machine, that is, upstream on the path of the working fluid (compressed air) flowing from receiver 30 into chamber 3 (or 4).

Note: The term "inject" also implies injection of combustible gas to obtain a fuel mixture.

After usable working fluid has filled the chamber, it is ignited, according to embodiments, as follows:

a. In chamber 3 (or 4), starting with the moment when driving member 1 has moved to a position at 12:00;

b. In chamber 17 (or twin chamber), starting with the moment when driving member 1 (FIG. 10) has moved to a position at 12:00; and c. In chamber 5 (or 6), in a position of driving member 1 past 12:00 (depending on the configuration of chamber 5 (or 6), position 13 in FIG. 1).

Note: The fuel mixture is ignited electrically, or spontaneously as compressed air attains a high temperature in chamber 6 (or 5), or alternately, and so on. Optimal locations of electric igniters (spark plugs) can be determined additionally: in housing part 11, end-face covers 15, driving member 1 upstream of chambers 17, and so on. Spark plug locations are not shown for convenience.

The compression stroke occurs as driving member 1 turns through 180 degrees and working fluid is drawn concurrently and alternately into chambers 6 (or 5), the working fluid is compressed in chamber 5 (or 6), and chambers 4 (or 3), 17 are purged of preceding cycle combustion products through purge ports 6.

High working fluid pressure built up in working chamber 3 (or 4) affects surrounding machine components, so that:

Pressure on the housing portion a-b does not generate a torque relative to the center of rotation O* of the driving member (pressure on housing part 11);

Pressure on the portion d-c does not generate a torque relative to the center of rotation O* of the driving member (actually, pressure on a pivot with a center O);

Pressure on the portion b-c generates a positive torque relative to the center of rotation O* of the driving member (pressure is transmitted to the rotor, in particular, via annular elements 7, strips 9, pivotal elements 2, segmental elements 8, and rotor covers 14); and Pressure on the portion a-d generates an insignificant negative torque relative to the center of rotation O* of the driving member (pressure is transmitted to the rotor, in particular, to segmental elements 8 held together by rotor covers 14, and to annular elements 3 joined by strips 9 to pivotal elements 2 and driving member 1).

Note: The above negative torque is only associated with FIGS. 1 to 11, and does not apply to other embodiments, which lack a plate with sides "a" and "d".

Working fluid is drawn in and chambers 5 and 6 are filled with fresh working fluid after a successive turn of driving member 1 through 180 degrees (FIGS. 1-4, and 14-17) via passages extending through housing end-face covers 15 (not shown for convenience).

After driving member 1 has turned 180 degrees, the cycle is repeated.

Summary: All essential events of a cycle take place at every turn of driving member 1 together with the rotor through 180 degrees, whereupon another cycle occurs, that is, preparatory and working strokes occur at a ratio of 1:1.

The only exception is operation of a working machine embodiment in which fuel is injected into chamber 5 (or 6), followed by a working stroke. In this embodiment, however, chamber 5 is purged during another full revolution (360 degrees), that is:

(A) Working stroke of driving member 1 (chamber 6): 180 degree turn and simultaneous compression in chamber 5 and fuel (gas) injection—180 degree turn (which gives a total of 180 degree turn of driving member 1);

(B) Purging of chamber 6: 180 degree turn and simultaneous working stroke (chamber 5)—180 degrees (giving a total of 360 degrees);

(C) Suction of clean air into chamber 6 and simultaneous purging of chamber 5—180 degrees (giving a total of 540 degrees); and (D) Compression in chamber 6: 180 degree turn and simultaneous suction of clean air into chamber 5 and injection of fuel (gas)—180 degrees (giving a total of 720 degrees).

Summary: Every turn of driving member 1, together with the rotor, through 720 degrees generates a torque through 360 degrees, and the next 360 degree turn is taken up by preparatory events, that is, the preparatory and working strokes occur at a ratio of 1:2.

Working chambers 3 and 4, and 17 are purged, respectively, by driving member 1 displacing the combustion products through the purge ports, and working chambers 17 are purged by air injected thereinto from chambers 21 (FIG. 10) in the turning zone between 6:00 and 9:00 as the combustion products are displaced by segmental elements 8 through the purge ports as well.

Working machine elements can be used differently as well:

1. A two-lobed driving member 1 is replaced with a three-, four- or multi-lobed variety, with appropriate modifications of the key elements, without altering the idea of this invention. In the inventor's view, the above modifications in this invention are more preferred in larger and, therefore, more powerful versions of the rotary machine.

2. Driving member 1 is used as an intermediate receiver.

Description of the Rotary Machine Operating as a Pump

The claimed rotary machine is used as a pump for compressing air and other agents, for example, according to the following scenario (FIG. 25):

As driving member 1 turns 180 degrees (clockwise) together with the rotor, the volume (on suction and filling) of chamber 4 reaches a maximum, the volume of air in chamber 3 remaining after the preceding stroke (at bottom) is compressed and transferred to chamber 5 via the valve passages in circular elements 7 (not shown for convenience), the volume of chamber 3 starts to be filled with atmospheric air through intake ports 31, and the volume of chamber 5 reaches a maximum.

The volume of chamber 4 is compressed and compressed air flows, via valve openings in circular elements 3, into chamber 6;

The volume of chamber 4 decreases, that is, recompression takes place in a second-stage compressor within the rotor, and then compressed air is exhausted from chamber 5 (or 6) beyond the rotary machine via end-face cover 15 of the rotor into storage receiver 30, if any; and This cycle is repeated every 180 degree turn of driving member 1, because working fluid (air) is compressed at the first stage (beyond the rotor) and simultaneously working fluid (air) is compressed at the second stage (within the rotor) over the 180 degree turn of the rotor together with driving member 1.

An engine plant (FIG. 21) comprises rotary machine 28 operating as a two-stage compressor pump to compress air and transfer it to central receiver 30, and them deliver it to rotary machines 29 used as engines, in particular, into their working chambers 3 and 4 or 5 and 6, depending on the preferred operation mode.

This design features a set of rotary machines 29 to operate as an engine and a set of rotary machines 28 to operate as a pump. Moreover, the engine unit having a set of rotary machines is self-sustaining in the sense of self-contained operation in a normal and quiet mode, and a pump unit of this type can:

Direct additional compressed air alternately into main working chambers 3 and 4 for supercharging purposes by analogy with turbine-powered engines. Air compressed by the pump is directed, via the end-face covers of the pump machine housing via passages provided with valve means directly to chambers 5 and 6 for further compression in the rotary engine unit, and for successive processes.

Pump mode used for preliminary storage of compressed air in central receiver 30, without using it for directly supplying the working chambers of a rotary machine operated as an engine, that is, the machine can be used, in an "engine braking" mode to provide additional resistance to engine operation.

Summary:

The claimed pump can, over every 180 degree turn of driving member 1 together with the rotor, compress air in the manner of a compressor having two working fluid compression stages.

The claimed pump can be used in an engine plant if operated in a recuperative mode, which means that braking energy released by slowing down rotation of the driving member in an engine unit is used, in part or in full, to compress working fluid and store it in a receiver as useful work for later use.

Objects of the Claimed Invention

The objects for which the claimed invention has been developed are:

1. Developing a rotary machine wherein a torque could be generated over each 180 degree turn of driving member 1 and all the following events take place simultaneously with the turning thereof:

Working fluid is compressed;

A working stroke is performed;

The chambers containing the "waste" working fluid are purged; and

Fresh working fluid is drawn in.

2. Developing a general-purpose kinematic design and routines for operating the machine depending on objectives by allowing a choice of a gas-dynamic process to be made, and designating the functions of machine elements.

3. Operating the claimed rotary machine as an internal combustion engine and a pump using their characteristic high-technology devices, such as digital control systems; fuel injection systems, including diesel fuel injection systems; valves; and so on.

4. Developing a rotary machine operating as a two-stage compressor pump.

5. Making the machine design relatively simple, lowering material consumption rates of the machine per kilowatt of output mechanical power, wide-scale application of available modem technologies, and so on.

6. Achieving a significant reduction in the cost of the claimed machine, all other conditions being the same, in relation to traditional internal combustion engines by using less complicated and less expensive processes to manufacture the machine.

Principal Elements of the Rotary Machine (A) The engine has a cylindrical housing consisting of two intersecting cylinders 11 and 12 of a larger diameter and a smaller diameter, which have parallel axes extending at a distance OO* from one another (giving a certain amount of eccentricity). The diameter of larger cylinder 11 is equal to that of driving member 1 plus a required spacing that includes the thickness of the seals of driving member 1, taking account of their deformation characteristics with heating. The diameter of smaller cylinder 12 is equal to the outer diameter of a rotor plus a required tolerance to account for rotor heating. The housing is made of metal and composite materials having a minimum coefficient of volumetric expansion. A cooling liquid or gas (not shown for convenience) circulates in housing passages parallel to the generating lines of cylinders 11 and 12. Cylinders 11 and 12 are provided on both sides with housing covers 15 defining a closed space within the cylinders. Two openings are provided (on either side of the housing) in covers 15 at the center O* of the larger cylinder circumference for mounting and sealing a shaft and driving member 1, such as a parallelepiped-shaped flap (FIGS. 1 to 11) with cylindrical short sides tightly adjoining the inner surface of cylinder 11, to be securely mounted thereon. The centers of end-face rotor covers 14 can be provided, on the axis of rotation O of the inner rotor, with orifices for alternately supplying and exhausting air to and from chambers 5 (or 6), supplying a fuel mixture, gaseous fuel, and so on, arranging fuel injectors, spark plugs, and so on.

Fuel injectors and spark plugs also can be positioned on the side surface of housing cylinder 11, in the area of chamber 3 (or 4), with driving member 1 in a position between 0:00 and 6:00.

The side wall of the housing is provided with openings 10 to discharge waste gases (in driving member position between 5:00 and 9:00).

Location of the injectors, valves, spark plugs, and their apertures, in combination with valve passages for circulating a working fluid (fuel mixture, air or gas), orifices for exhausting waste gases and purging the chambers is chosen depending on the operation scenario of the claimed rotary machine.

The inner surface of housing cylinder 12 can be rippled to produce eddy flows in the working fluid flowing out of chamber 3 (or 4) toward a position at 9:00, so as to "seal off" this portion as fully as possible.

(B) Driving member 1, or flap, is a critical element provided to:

Generate a torque;

Compress gas, mixture or air in chamber 5 or 6, jointly with the surrounding elements, in particular, segmental rotor parts 8, cylindrical pivotal elements 2, annular sectoral elements 7, housing elements, in particular, flange housing covers 14, and rotor covers 15;

Evacuate combustion products from chamber 3 or 4;

Evacuate combustion products from chamber 5 or 6;

Store gas, mixture or air in the receiver of driving member 1 (11 in FIG. 10) and in rotor elements 8, 7 and so on (depending on the operation scenario of the rotary machine);

Produce a working fluid following ignition and explosion of the mixture and abrupt rise in pressure in working chamber 17 (FIG. 10) in the flap, chamber 6 (or 5) or chamber 3 (or 4), depending on the operation scenario of the rotary machine;

Exhaust combustion products and compressed medium (air, mixture or gas) into crescent-shaped chamber 3 or 4 through nozzle-shaped apertures (slits) 18 at the ends of driving member (flap) 1 (FIGS. 10 and 11) in a direction opposite to the direction of rotation through one or several nozzles to fill crescent-shaped chamber 3 (or 4) as fast as possible and obtain the largest possible reactive component of a positive torque and a powerful piston effect in chambers 3 and 4;

Engage closed cylindrical pivotal elements 2, strips 9, and annular elements 7 that serve to transmit rotational forces to segmental elements 8 (FIG. 1);

Provide adequate sealing between compressed volumes in chambers 5 and 6, crescent-shaped working chambers 3 and 4, and chambers 17;

Supply a working fluid, or air, to chamber 17 and 21 via one-way valves 23;

Direct the working fluid, following injection of fuel into chambers 17 and ignition as one-way valve 23 opens as pressure generated by mixture firing rises above the pressure maintained in the fluid filling chambers 17, into chamber 3 (or 4, after a 180 degree turn of driving member 1). Following a working stroke (180 degree turn of driving member 1) to discharge waste working fluid through purge ports 10, valve 25 opens, and chambers 17 are purged by pressurized air from chamber 21 (or twin chamber, respectively). Valves 22 operate in three modes;

Discharge combustion products from chambers 5 and 6 (FIG. 10), through passages 19 after the opening of valve 26 to alternately build up high pressure therein to produce torque;

Store compressed air when driving member 1 is used as an intermediate receiver; and Cause driving member 1 of a rotary machine used as a pump to deliver, via passages 19 and valves 24 and 26 operating in the opposite direction, first-stage compressed air alternately into chambers 3* and 3** for second-stage compression.

In geometric shape, driving member 1 is essentially a parallelepiped with radial short ends (A and A'), complementary to the radial curvature of the inner surface of large-diameter housing cylinder 11. The outer faces of driving member 1 are provided, if at all, with sealing elements and elements to clean the friction surfaces (not shown for convenience).

(C) Cylindrical pivotal element 2.

Figure 26:
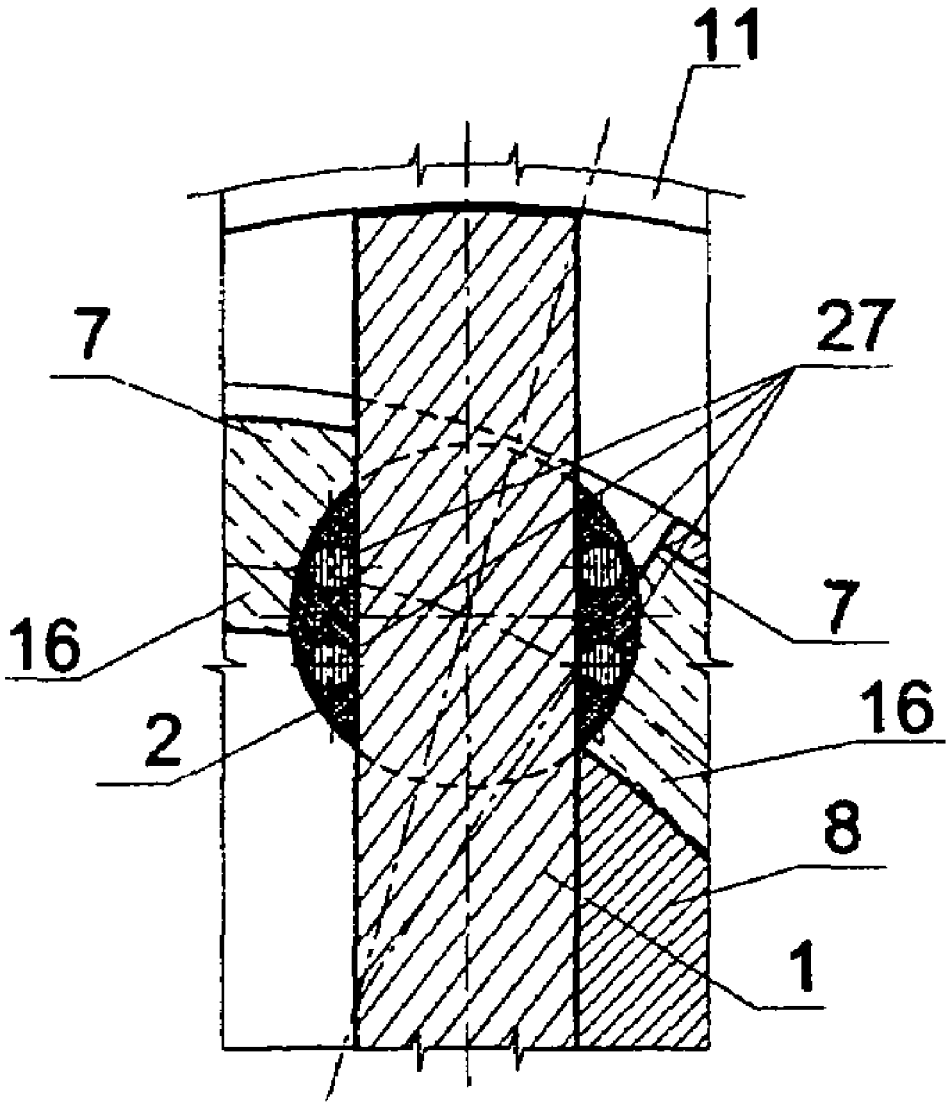

Cylindrical pivotal element 2 is provided to:

Transfer the torque to annular elements 7 of the inner rotor, held together by strips 9, which are engaged by pivotal elements 2 supported on rollers, or rolling-contact bearings 27 (FIG. 26);

Permit free movement of driving member 1 in pivotal elements 2 to achieve required tightness between adjacent chambers 3, 4, 5 and 6 via a pivotal element 2 itself and the contact surfaces and driving member 1, annular elements 7, strips 9, rotor covers 14 and housing covers 15, which is achieved by using appropriate materials having a high wear resistance, a low coefficient of volumetric expansion, and high refractoriness. The sliding inner contact surfaces of pivotal elements 2 can be provided, at the side of flap 1, with concealed support roller elements 27 in order to reduce the non-uniform wear of contact surfaces during rotation.

Cylindrical pivotal element 2 is a cylinder with an inner slot complementary to the shape of driving member 1 to ensure tight contact therewith.

(D) Annular (annular sectoral) elements 7.

Annular elements 7 perform the following functions:

Annular, pivotal and segmental elements 7, 2 and 8, strips 9, and rotor covers 14 produce an inner rotor. In embodiment I, segmental elements and flange rotor covers 14 (FIGS. 1 to 7) are rigidly fastened together to form a cylindrical element with parts of driving member 1 projecting at the sides thereof;

Annular elements 7 are designed to separate the inner spaces of compression chambers 5 and 6, and crescent-shaped working chamber 3 or 4;

When the rotary machine is used as a pump, one-way valves are to be provided in the intake orifices of annular elements 7;

With friction forces of sliding surfaces (not shown) and rolling surfaces (not shown) reduced to a minimum, annular elements 7, as they are aligned with strips 9 (FIG. 6), ensure maximum possible tightness of the adjacent chamber spaces;

Annular elements 7 in FIGS. 14 to 24 balance the rotating elements themselves (elements 8 and 7, respectively) as a result of their greater overlap and respective displacement of the centers of gravity, or transfer, via strips 9, forces generated by accelerations of different magnitude and sign (variable angular rotational velocities of inner rotor elements) acting upon outer balancing elements located, for example, between rotor covers 14 and flange housing covers 15.

The rotating rotor can also be balanced by other balancing devices that are outside of the scope of this invention;

At the side of end faces, the projecting cylindrical surfaces of these annular elements 7 slide on rollers that can rotate on strips 9 (FIG. 6) holding annular elements 7 together;

At the side A of the driving member, annular elements 7 push segmental elements 8 from the position of driving member 1 at 9:00 to 3:00, and then, at the side A', they push segmental elements 8 from the position of driving member 1 at 3:00 to 9:00. The cycle is then repeated. This operation pattern is typically used in the first embodiment of the claimed rotary machine;

Annular elements 7 have reinforcing plates 16 to impart greater geometric stability to the structure and, simultaneously, to transfer heat to the working fluid in chambers 5 and 6;

The annular elements 7 differ in geometric shape in different embodiments of the rotary machine, but they are identical in essence.

(E) Segmental parts (segmental elements, components, elements) 8.

With the smallest possible slit gap in the contact area between segmental elements 8 and the inner surface of smaller housing cylinder 12, the segmental elements 8 are to maintain the highest possible fluid tightness of the crescent-shaped chamber and chambers 3, 4, 5 and 6 during rotation of driving member 1;

Segmental element 8 is used, together with surrounding adjacent elements 2, 7, 14 and 15 that define chambers 5 and 6 to compress the working fluid;

Segmental element 8 is rigidly coupled with rotor covers 14 to form a virtually integral element in the embodiments of FIGS. 1 to 11, but they are separate in the other embodiments;

Segmental element 8 can function as a receiver and transfer compressed air from chamber 6 (or 5) to chamber 3 (or 4) for fuel to be injected at a later phase;

Segmental elements 8 have complementary recesses for annular elements 7;

Segmental elements 8 (viewed along line 13) can have an inner space for engagement by driving member 1 so as to make its volume and shape acceptable for operation on diesel fuel, allowing for injectors and other elements to be arranged in covers 14 and 15;

Segmental elements 8 can draw air at the suction phase into their empty spaces (when moving apart) and discharge air upon compression (with the driving member positioned at 0:00 and 6:00) via passages provided with appropriate valves (not shown not convenience). Part of the compressed air can be accumulated in segmental element 8 functioning as a receiver for further utilization, such as building up an additional volume of compressed air (working fluid) in chambers 5 and 6; and In idle operation, when no fuel is burned, or at braking, when fuel is not injected into chambers 3 and 4, the rotating rotor can pump air rapidly into segmental elements 8 functioning as receivers. This air can then be used to maintain working processes in the rotary machine and to locally cool rotor elements, if required.

(F) Rotary machine balancing.

The rotary machine is balanced by balancing elements provided in the three principal embodiments thereof by:

Attaching additional assemblies to the rotary machine and offsetting driving members 1 and rotors, for example, by 90 or 180 degrees relative to one another in phase, that is, by balancing all the assemblies together;

Designing elements in a second embodiment of the rotary machine in such a way that they are in balance relative to the axis of rotation O;

Positioning balancing elements between rotor covers 14 and false covers (not shown for convenience) and housing covers 15 attached, via strips 9, to cylindrical pivotal elements 2 at points M and K (FIG. 7); and Using an embodiment combining the above variants.

Note: Rotary machine balancing is not disclosed in this patent.

INDUSTRIAL USAGE

The proposed rotary machine can be used as an engine or a pump unit owing to high efficiency in many branches of industry such as automotive industry, tank—building, motor—building, heavy machine—building, aerospace industry, shipbuilding, etc.

The invention claimed is:

1. A rotary machine comprising a housing and a rotor received therein, characterized in that the inner surface of the housing is shaped by two intersecting cylinder parts having different diameters and parallel axes; the rotor received in the housing is coaxial with the smaller-diameter cylinder and has at least two segmental rotor parts mounting annular rotor covers and at least two pairs of annular elements connected in pairs and adapted to turn relative to the segmental rotor parts; the machine further comprises pivotal elements accommodated between the annular elements of each pair; a driving member, whose axis of rotation is coincident with the axis of the larger-diameter cylinder and which is received in openings of the pivotal elements for movement therein to bring working surfaces of said driving member, during rotation thereof, into contact with inner working surfaces of the segmental rotor parts, rotor covers, and an inner end-face and said cylindrical surfaces of the housing in order to define inner variable-volume working chambers between the segmental rotor parts and the driving member, and outer variable-volume working chambers between the driving member, the inner surfaces of the housing, and the outer surfaces of the rotor.

2. A rotary machine as claimed in claim 1, characterized in that the pairs of annular elements are designed to move in inner annular guides of the segmental rotor parts and engage with said segmental rotor parts.

3. A rotary machine as claimed in claim 1, characterized in that the pairs of annular elements embrace the segmental rotor parts and are in contact with the inner cylindrical surface of the smaller-diameter housing part for movement in the annular guides of the segmental rotor parts and engagement with said segmental rotor parts.

4. A rotary machine as claimed in claim 1, characterized in that the pairs of annular elements embrace the segmental rotor parts and are in contact with the inner cylindrical surface of the smaller-diameter housing part for movement of annular elements in annular guides of one another and engagement with the segmental rotor parts.

5. A rotary machine as claimed in claim 3 or 4, characterized in that the pairs of annular elements embrace one another on two sides during movement relative to one another.

6. A rotary machine as claimed in any of claims 2, 3 or 4, characterized in that the pairs of annular elements are adapted to move in annular guides of the rotor covers.

7. A rotary machine as claimed in claim 1, characterized in that the openings of the pivotal elements have a shape complementary to the shape of the driving member and are adapted to slide therein.

8. A rotary machine as claimed in claim 1, characterized in that the end-faces of the pivotal elements are provided at connecting points of the annular elements in rolling-contact bearings.

9. A rotary machine as claimed in claim 1, characterized in that the openings of the pivotal elements accommodate rolling-contact bearings for engaging the driving member.

10. A rotary machine as claimed in claim 1, characterized in that the annular elements have reinforcing and cooling plates.

11. A rotary machine as claimed in claim 1, characterized in that the driving member comprises a single plate or a plurality of interconnected plates and has a two-, three- or multi-lobed cross-section so that the lobes are received in the pivotal elements, the angles between the lobes are equal, and each segmental rotor part has a flat or two-sided surface, the angle between the lobes being equal to that between the sides to ensure contact between the driving member and the segmental rotor parts during rotation thereof.

12. A rotary machine as claimed in claim 9, characterized in that the driving member has parallel side faces and rounded short sides interacting with the inner cylindrical surface of the larger-diameter housing part.

13. A rotary machine as claimed in claim 10, characterized in that the rounded short sides of the driving member have a radius of curvature larger than the distance from the center of rotation of the rotor to the pivotal elements.

14. A rotary machine as claimed in claim 1, characterized in that the driving member comprises a casing, wherein each part of the casing between an axis of rotation of the rotor and each of working surfaces designed to be in contact with the inner cylindrical surface of the housing is provided with communicating inner chambers, the first of which is a combustion working chamber and the second chamber is designed to be filled with a working fluid for subsequently purging the first working chamber so that a fuel mixture is injected into it and combustion products are discharged into a main working chamber of the rotary machine.

15. A rotary machine as claimed in claim 12, characterized in that the driving member has passages and valves provided therein for transferring working fluid to a working chambers following compression thereof.

16. A rotary machine as claimed in claim 14, characterized in that each of the combustion working chambers has double walls.

* * * * *